US011375772B2

(12) United States Patent
Meir

(10) Patent No.: US 11,375,772 B2
(45) Date of Patent: Jul. 5, 2022

(54) ARTICLE OF FOOTWEAR INCORPORATING A KNITTED COMPONENT HAVING FLOATED PORTIONS

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 76 days.

(21) Appl. No.: 16/778,575

(22) Filed: Jan. 31, 2020

(65) Prior Publication Data

US 2020/0163414 A1 May 28, 2020

Related U.S. Application Data

(63) Continuation of application No. 15/094,547, filed on Apr. 8, 2016, now abandoned.

(60) Provisional application No. 62/148,531, filed on Apr. 16, 2015.

(51) Int. Cl.

| | |
|---|---|
| ***A43B 23/02*** | (2006.01) |
| ***D04B 1/10*** | (2006.01) |
| ***D04B 1/22*** | (2006.01) |

(52) U.S. Cl.

CPC ..... *A43B 23/0245* (2013.01); *A43B 23/0205* (2013.01); *A43B 23/026* (2013.01); *D04B 1/102* (2013.01); *D04B 1/22* (2013.01); *D10B 2501/043* (2013.01)

(58) Field of Classification Search

CPC ..... A43B 1/04; D04B 1/102; D04B 21/06

See application file for complete search history.

(56) References Cited

U.S. PATENT DOCUMENTS

| | | | | | |
|---|---|---|---|---|---|
| 2,102,368 | A | * | 12/1937 | Martel | D04B 1/18 66/182 |
| 2,311,166 | A | * | 2/1943 | Fregeolle | D04B 9/54 66/172 E |
| 3,729,956 | A | * | 5/1973 | Nebel | D04B 1/26 66/172 E |
| 3,986,374 | A | * | 10/1976 | Fane | D04B 1/102 66/190 |
| 4,015,448 | A | * | 4/1977 | Knohl | D04B 9/52 66/185 |

(Continued)

FOREIGN PATENT DOCUMENTS

| | | |
|---|---|---|
| CN | 201468180 U | 5/2010 |
| CN | 205696052 U | 11/2016 |

(Continued)

OTHER PUBLICATIONS

Fourth Office Action and English Translation for Chinese Patent Application No. 201610237157.5 dated Jun. 4, 2019; 18 pages.

(Continued)

*Primary Examiner* — Megan E Lynch

(74) *Attorney, Agent, or Firm* — Shook Hardy & Bacon, L.L.P.

(57) ABSTRACT

An article of footwear may include an upper incorporating a knitted component formed of unitary knit construction. The knitted component includes portions having extended floated portions to distribute forces acting on the knitted component and resist stretching of the knitted component when the article of footwear is worn during a sport or athletic activity.

13 Claims, 32 Drawing Sheets

(56) References Cited

U.S. PATENT DOCUMENTS

| | | | | |
|---|---|---|---|---|
| 4,034,581 | A * | 7/1977 | Swafford | D04B 1/26 66/180 |
| 4,149,274 | A * | 4/1979 | Garrou | A41B 11/02 2/239 |
| 4,216,662 | A * | 8/1980 | Harris, Jr. | D04B 1/26 66/185 |
| 4,499,742 | A * | 2/1985 | Burn | D04B 1/26 66/172 E |
| 4,967,494 | A | 11/1990 | Johnson | |
| 5,412,957 | A * | 5/1995 | Bradberry | A61F 13/08 2/239 |
| 5,615,562 | A * | 4/1997 | Roell | D04B 15/565 66/126 R |
| 6,079,235 | A * | 6/2000 | Schmidt | D04B 9/34 66/136 |
| 6,227,010 | B1 | 5/2001 | Roell | |
| 6,986,269 | B2 | 1/2006 | Dua | |
| 8,448,474 | B1 | 5/2013 | Tatler et al. | |
| 8,997,530 | B1 | 4/2015 | Podhajny | |
| 2002/0152775 | A1* | 10/2002 | Browder, Jr. | A41C 1/003 66/170 |
| 2006/0010931 | A1 | 1/2006 | Lynch et al. | |
| 2007/0298666 | A1* | 12/2007 | Kurth | D04B 1/16 442/1 |
| 2009/0117799 | A1* | 5/2009 | Yoshida | D02G 3/04 442/182 |
| 2010/0018075 | A1 | 1/2010 | Meschter et al. | |
| 2012/0234051 | A1* | 9/2012 | Huffa | A43B 1/04 66/64 |
| 2012/0284902 | A1* | 11/2012 | Matsuo | D04B 1/104 2/239 |
| 2013/0160323 | A1 | 6/2013 | Hsiao | |
| 2013/0263629 | A1* | 10/2013 | Gaither | A41B 11/003 66/185 |
| 2013/0269209 | A1 | 10/2013 | Lang et al. | |
| 2013/0269212 | A1 | 10/2013 | Little | |
| 2014/0137433 | A1 | 5/2014 | Craig | |
| 2014/0150292 | A1 | 6/2014 | Podhajny et al. | |
| 2014/0237861 | A1* | 8/2014 | Podhajny | D04B 1/22 36/9 R |
| 2014/0245545 | A1* | 9/2014 | Meir | A43B 23/0245 12/142 G |
| 2015/0075031 | A1 | 3/2015 | Podhajny et al. | |
| 2015/0320136 | A1* | 11/2015 | Dua | A43B 23/0245 36/9 R |
| 2016/0017521 | A1* | 1/2016 | Thomson | D01F 8/06 66/171 |
| 2016/0029736 | A1 | 2/2016 | Meir | |
| 2016/0174660 | A1* | 6/2016 | Iuchi | A43B 23/0235 36/45 |
| 2016/0251782 | A1* | 9/2016 | Liao | D04B 1/18 66/202 |
| 2016/0302527 | A1 | 10/2016 | Meir | |

FOREIGN PATENT DOCUMENTS

| | | | |
|---|---|---|---|
| JP | 2015-066280 | A | 4/2015 |
| NO | 2015/011156 | A1 | 1/2015 |
| TW | 201402030 | A | 1/2014 |
| TW | M498500 | U | 4/2015 |
| WO | WO 2013/126313 | A2 | 8/2013 |

OTHER PUBLICATIONS

International Preliminary Reporton Patentability for International Application No. PCT/US2013/070651, dated Jun. 4, 2015.
International Preliminary Reporton Patentability in corresponding International Application No. PCT/US2016/026345, dated Oct. 17, 2017, 13 pages.
International Search Report and Written Opinion for International Application PCT/US2012/028534, dated Oct. 17, 2012 (16 pages).
International Search Report and Written Opinion for International Application No. PCT/US2013/070651, dated Mar. 27, 2014 (14 pages).
International Search Report and Written Opinion for International Application No. PCT/US2015/015340, dated Apr. 28, 2015 (10 pages).
International Search Report and Written Opinion for International Application No. PCT/US2015/015343, dated Jun. 16, 2015 (11 pages).
International Search Report and Written Opinion for International Application No. PCT/US2015/015346, dated Apr. 22, 2015 (10 pages).
International Search Report and Written Opinion for International Application No. PCT/US2016/026345, dated Oct. 4, 2016 (20 pages).
Office Action and English language translation thereof in corresponding Chinese Patent Application No. 201610237157.5 dated Apr. 11, 2018; 6 pages.
Office Action and English language translation thereof in corresponding Chinese Patent Application No. 201610237157.5 dated Oct. 19, 2018; 5 pages.
Office Action and English language translation thereof in corresponding Chinese Application No. 201610237157.5, dated Aug. 2, 2017, 11 pages.
Office Action for Chinese Application No. 2013800364497, dated Sep. 25, 2015 (6 pages).
Office Action for European Application No. 13814673.3, dated Jun. 30, 2015 (2 pages).
Office Action for Korean Application No. 10-2014-7036252, dated Jan. 21, 2016 (11 pages).
Office Action for Taiwanese Application No. 102142337, dated May 27, 2015 (36 pages).
Office Action for Taiwanese Application No. 102142337, dated Sep. 21, 2015 (33 pages).
Office Action for Taiwanese Application No. 105111914, dated Dec. 26, 2016 (19 pages).
Intention to Grant received for European Patent Application No. 16718092.6, dated Jul. 5, 2021, 4 pages.
Extended European Search Report received for European Patent Application No. 21194072.1, dated Jan. 13, 2022, 9 pages.

* cited by examiner

ARTICLE OF FOOTWEAR INCORPORATING A KNITTED COMPONENT HAVING FLOATED PORTIONS

RELATED APPLICATIONS

This application is a continuation of U.S. patent application Ser. No. 15/094,547, filed Apr. 8, 2016, entitled "ARTICLE OF FOOTWEAR INCORPORATING A KNITTED COMPONENT HAVING FLOATED PORTIONS," which claims the benefit of U.S. Provisional Application Ser. No. 62/148,531, filed Apr. 16, 2015. Each application listed in this paragraph is hereby incorporated by reference in its entirety.

BACKGROUND

Conventional articles of footwear generally include two primary elements, an upper and a sole structure. The upper and the sole structure, at least in part, define a foot-receiving chamber that may be accessed by a user's foot through a foot-receiving opening.

The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

The sole structure is secured to a lower area of the upper, thereby positioned between the upper and the ground. The sole structure may include a midsole and an outsole. The midsole often includes a polymer form material that attenuates ground reaction forces to lessen stresses upon the foot and leg during walking, running, and other ambulatory activities. Additionally, the midsole may include fluid-filled chamber, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g. textiles, polymer form, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear which may cause failure or discomfort. Additional material and stitch joints may lead to discomfort when worn. By decreasing the number of material elements utilized in the upper, therefore, waste may be decreased while increasing the manufacturing efficiency, the comfort, performance, and the recyclability of the upper.

SUMMARY

In one aspect, an article of footwear includes an upper and a sole structure secured to the upper. The upper includes a knitted component. The knitted component includes a first course and a second course. The first course extends from a first area of the knitted component to a second area of the knitted component along a first knitting direction. The first course includes a first loop and a second loop. The first loop and the second loop are separated by a plurality of loops. The second course extends from the first area to the second area. The second course includes a first tuck stitch and a second tuck stitch. The first tuck stitch interacts with the first loop. The second tuck stitch interacts with the second loop. The second course includes a floated portion that extends from the first tuck stitch to the second tuck stitch. The floated portion extends over the plurality of loops of the first course. And, the second course is configured to resist stretch in at least a first portion of the upper.

In another aspect, an article of footwear includes an upper and a sole structure secured to the upper. The upper incorporates a knitted component. The knitted component includes a stretch resistant area formed of a plurality of courses. At least a first course incorporates a floated portion. A first loop being located at a first end of the floated portion, a second loop being located at a second end of the floated portion.

In another aspect, a method of making an article of footwear having an upper and a sole structure secured to the upper is disclosed. The upper incorporates a knitted component. The knitted component is formed by knitting a first course and a second course. The first course extending from a first area of the knitted component to a second area of the knitted component along a first knitting direction. The first course including a first loop located in the first area and a second loop located in the second area. The first loop and the second loop being separated by a plurality of loops. The second course extending from the first area to the second area. The second course including a first tuck stitch and a second tuck stitch. The first tuck stitch interacting with the first loop. The second tuck stitch interacting with the second loop. The second course including a floated portion extending from the first tuck stitch to the second tuck stitch. The floated portion extending over the plurality of loops of the first course. And, the second course being configured to resist stretch in at least a first area of the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose a variety of concepts relating to knitted components and the manufacture of knitted components. Although the knitted components may be utilized in a variety of products, an article of footwear that incorporates one of the knitted components is disclosed below as an example. In addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Footwear Configuration

Figure 1:
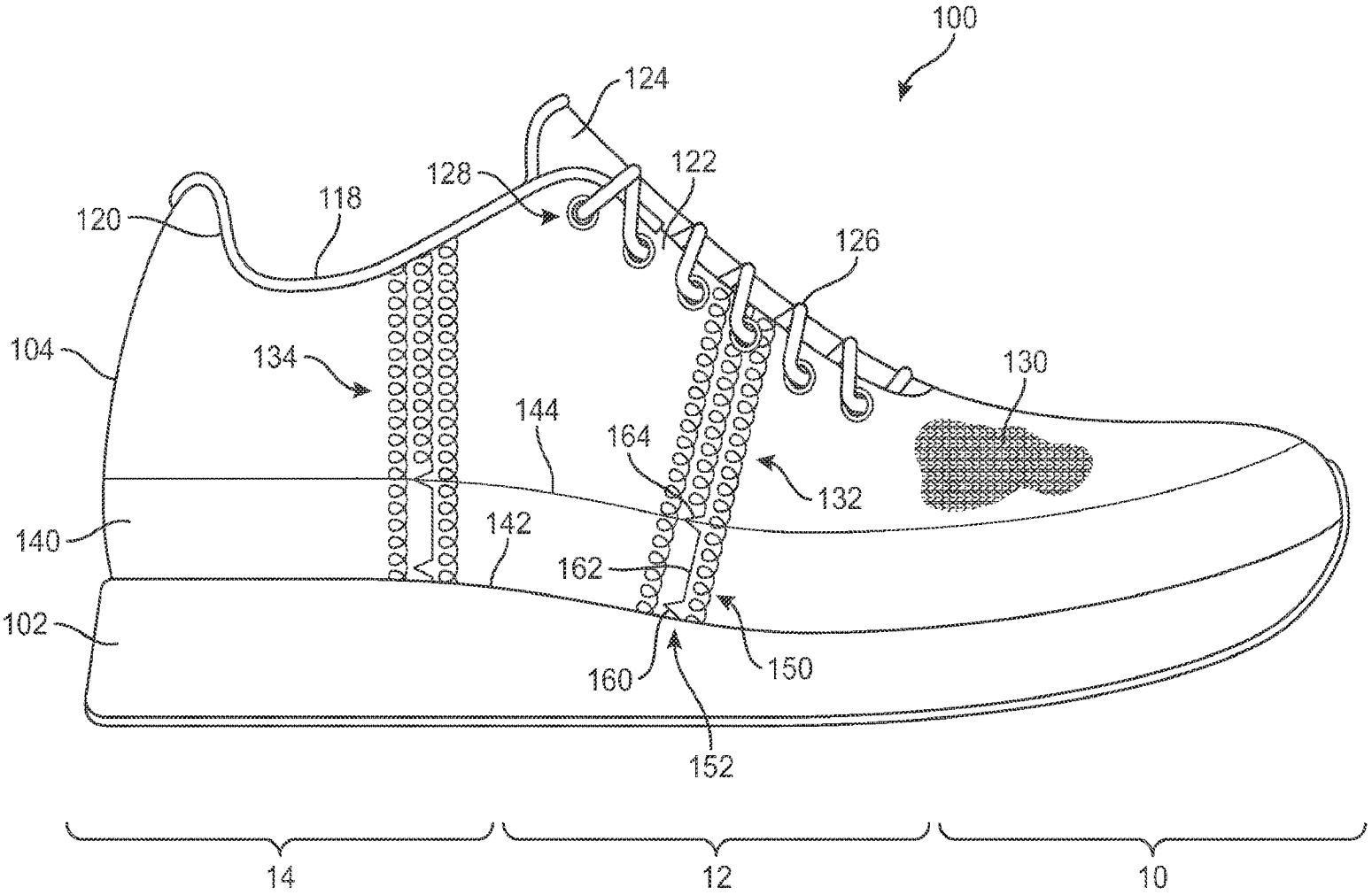
FIG. 1 is a side view of an exemplary embodiment of an article of footwear.
Figure 2:
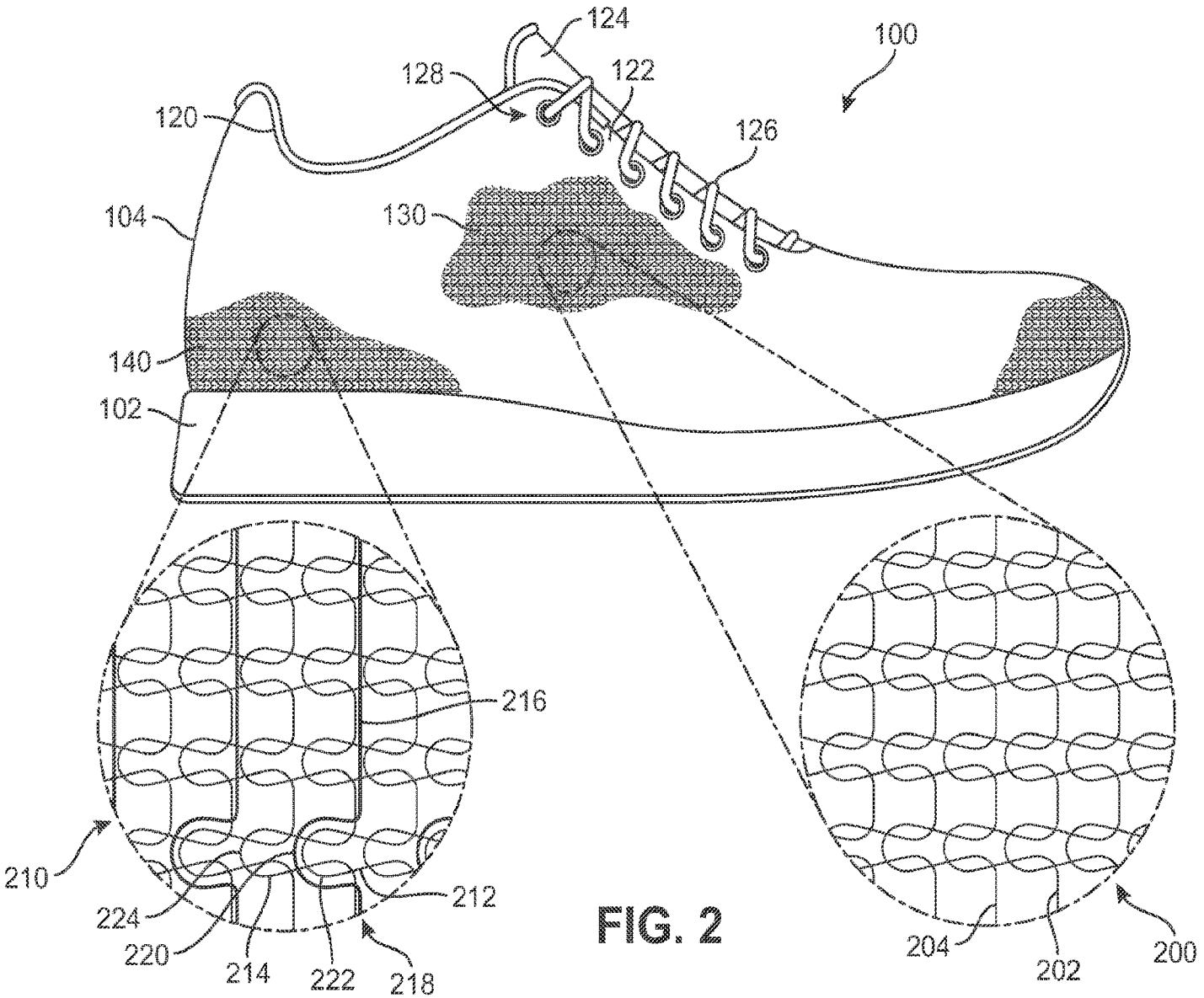
FIG. 2 is a side view of an exemplary embodiment of an article of footwear including varying knit structures.

An article of footwear 100 is depicted in FIGS. 1-2 as including a sole structure 102 and an upper 104. Although article of footwear 100, also referred to hereafter as simply article 100, is illustrated as having a general configuration suitable for running, concepts associated with footwear may also be applied to a variety of other athletic footwear types, including baseball shoes, basketball shoes, cycling shoes, football shoes, tennis shoes, soccer shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to footwear apply to a wide variety of footwear types.

As best shown in FIGS. 1-2, article 100 may be divided into three general regions: a forefoot region 10, a midfoot region 12, and a heel region 14. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through forefoot region 10, midfoot region 12, and heel region 14, and correspond with opposite sides of footwear. More particularly, lateral side 16 corresponds with an outside area of the foot, and medial side 18 corresponds with an inside area of the foot (i.e., the surface that faces toward the other foot). Forefoot region 10, midfoot region 12, heel region 14, lateral side 16, and medial side 18 are not intended to demarcate precise areas of footwear. Rather, forefoot region 10, midfoot region 12, heel region 14, lateral side 16, and medial side 18 are intended to represent general areas of article 100 to aid in the following discussion. In addition to article 100, forefoot region 10, midfoot region 12, heel region 14, lateral side 16, and medial side 18 may also be applied to sole structure 102, upper 104, and individual elements thereof.

Further, reference may be made to directional descriptions. "Longitudinal" as used throughout this detailed description and in the claims refers to a direction extending the length of an article or component or portions thereof. In some cases, the longitudinal direction may extend from forefoot region 10 to heel region 14 or portions. The term "lateral" as used throughout this detailed description and in the claims refers to a direction extending a width of an article or portions thereof. In other words, the lateral direction may extend between lateral side 16 and medial side 18 of an article. Furthermore, the term "vertical" as used throughout this detailed description and in the claims refers to a direction generally perpendicular to a lateral and longitudinal direction.

In an embodiment, sole structure 102 is secured to upper 104 and extends between the foot and the ground when article 100 is worn. In some embodiments, the primary elements of sole structure 102 may include a midsole, an outsole, and a sockliner. In an exemplary embodiment, sole structure 102 may include an outsole. In an embodiment, outsole may be secured to a lower surface of upper 104. The outsole may also be secured to a base portion configured for securing sole structure 102 to upper 104. Although the configuration for sole structure 102 provides an example of a sole structure that may be used in connection with upper 104, many other conventional or nonconventional configurations for sole structure 102 may be utilized. Accordingly, the features of sole structure 102, or any sole structure used with upper 104, may vary in other embodiments.

For example, in other embodiments, sole structure 102 may include a midsole and/or a sockliner. The midsole may be secured to a lower surface of an upper and may be formed from a compressible polymer form element (e.g., a polyurethane or ethylvinylacetate form) that attenuates ground reaction forces (i.e., provides cushioning) when compressed between the foot and the ground during walking, running, or other ambulatory activities. In other configurations, midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of article of footwear 100.

In some embodiments, upper 104 defines a void within article 100 for receiving and securing a foot relative to sole structure 102. The void is shaped to accommodate a foot and extends along the lateral side of the foot, along a medial side of the foot, over the foot, around the heel, and under the foot. Access to the void is provided by an ankle opening 118 located in at least the heel region 14. The foot may be inserted into upper 104 through ankle opening 118 formed by collar 120. The foot may be withdrawn from upper 104 through ankle opening 118 formed by collar 120. In some embodiments, an in step area 122 may extend forward from ankle opening 118 and collar 120 over an area corresponding to an in step of the foot in midfoot region 12 to the forefoot region 10.

In some embodiments, upper 104 may include a tongue portion 124. Tongue portion 124 may be disposed between lateral side 16 and medial side 18 of upper 104 through the in step area 122. Tongue portion 124 may be integrally attached to upper 104. In some embodiments, tongue portion 124 may be formed of a unitary knit construction, which is defined in further detail below, with portions of upper 104. Accordingly, upper 104 may extend substantially continuously across in step area 122 between lateral side 16 and medial side 18. In some embodiments, tongue portion 124 may be attached along lateral side 16 and medial side 18 of instep area 122. In other embodiments, tongue portion 124 may be disconnected along the sides of instep area 122 allowing for tongue portion 124 to be moveable between the sides of instep area 122.

A lace 126 may extend through various lace apertures 128 to enhance the comfort of article 100. Lace 126 may allow for the wearer to modify the dimensions of upper 104 to accommodate proportions of the foot. In some embodiments, lace 126 may extend through lace apertures 128 that are disposed along either side of instep area 122. In some embodiments, lace apertures 128 are integrally formed within upper 104. In some embodiments, an inlaid strand or tensile element may form lace aperture 128. Lace 126 may permit the wearer to tighten upper 104 around the foot. Lace 126 may also permit the wearer to loosen upper 104 to facilitate entry and removal of the foot from the void. In addition, tongue portion 124 of upper 104 in instep area 122 extends under lace 126 to enhance the comfort of article 100. In some embodiments, lace apertures 128 may be formed from another material. In further configurations, upper 104 may include additional elements, such as (a) a heel counter in heel region 14 that enhances stability, (b) a toe guard in forefoot region 10 that is formed of wear-resistant material, and (c) logos, trademarks, and placards with care instructions and material information.

Many conventional footwear uppers are formed from multiple material elements (e.g., textiles, polymer form, polymer sheets, leather, synthetic leather) that are joined through stitching or bonding, for example. In contrast, in some embodiments, a majority of upper 104 is formed from a knitted component 130, which will be discussed in more detail below. Knitted component 130 may, for example, be manufactured through a flat knitting process and extends through one of more of forefoot region 10, midfoot region 12, and heel region 14 along both lateral side 16 and medial side 18. In some embodiments, knitted component 130 forms substantially all of upper 104 including an exterior surface and a majority or a relatively large portion of an interior surface thereby defining a portion of the void within upper 104. In some embodiments, knitted component 130 may also extend under the foot. In other embodiments, however, a Strobel sock or thin sole-shaped piece of material is secured to knitted component 130 to form a base portion of upper 104 that extends under the foot for attachment with sole structure 102.

Although seams may be present in knitted component 130, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided.

Knitted component 130 may incorporate various types of yarn that impart different properties to separate areas of upper 104. That is, one area of knitted component 130 may be formed from a first type of yarn that imparts a first set of properties, and another area of knitted component 130 may be formed from a second type of yarn that imparts a second set of properties. In this configuration, properties may vary throughout upper 104 by selecting specific yarns for different areas of knitted component 130. The properties that a particular type of yarn will impart to an area of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knitted component 130 may affect the properties of upper 104. For example, a yarn forming knitted component 130 may be a monofilament yarn or a multifilament yarn. The yarn may also include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 104. Accordingly, both the materials forming the yarn and other aspects of the yarn may be selected to impart a variety of properties to separate areas of upper 104.

Knitting direction, as discussed throughout the description and claims, refers to the orientation of interlooped yarns or strands forming a course or row of loops that are being joined to successive courses through a knitting process. The knitting direction may be generally defined relative to the direction of the knit material being formed during the knitting process. For example, during a flat knitting process, successive courses of interlooped yarns are joined together to form a knit element by manipulating a yarn through knitting a course or row along a generally horizontal direction to increase the size of the knitted component along a generally vertical direction.

Reference may be made to courses which form the knitted component. A "technical course" is used to refer to a row of needle loops produced by adjacent needles during the same knitting cycle. Each technical course refers to a pass of yarn along the knitting direction that interacts with at least one needle. In some embodiments, multiple technical courses may interact with one another to form a visual course. A "visual course" refers to a course as seen along the knitting direction. The height of a visual course is generally the same height as a needle loop within the visual course. A visual course may include multiple technical courses. For example, a visual course may include a first technical course that is formed of multiple jersey loops and a second technical course that is formed of tuck stitches and floated portions. The second technical course may interact with the first technical course, however, the tuck stitches of the second technical course may not extend beyond the height of the jersey loops of the first technical course. That is, the loops of the first technical course and the loops of the second technical course may interact with the same needles at the same time. Therefore, the height or length of a knitted component that incorporates the first technical course may not increase by the addition of the second technical course.

In some embodiments, knitted component 130 may incorporate courses that utilize differing stitch configurations. In some embodiments, knitted component 130 may utilize jersey stitches. In other embodiments, knitted component 130 may incorporate float stitches, tuck stitches, jacquard stitches, and other knit stitches.

In some embodiments, various stitches may be particularly located to take advantage of the properties of a particular stitch or loop. For example, a stretch resistant stitch may be located in an area of an article where stretch is undesirable, whereas a stitch that allows for stretch may be located in an area where stretch is desirable. Additionally, multiple stitches may be combined to achieve a particular property.

Referring to FIG. 1, the lateral side of an article of footwear is depicted. Upper 104 of article 100 may be formed utilizing knitted component 130. The technical aspects of knitted component 130 are depicted in technical component 132 and technical component 134 for ease of description and discussion in relation to this Detailed Description. Technical component 132 and technical component 134 are used to depict the technical placement and orientation of individual courses, however, when assembled, technical component 132 and technical component 134 may appear as does knitted component 130. Additionally, it should be recognized that knitted component 130 may be located throughout any one or more portions of upper 104.

In some embodiments, knitted component 130 may include various courses configured to impart particular properties to upper 104 using the material properties of the courses. In some embodiments, the courses may be formed of differing materials. For example, in some embodiments, knitted component 130 may include courses formed of stretch-resistant material. In other embodiments, knitted component 130 may include courses formed of elastic material. In still further embodiments, knitted component 130 may include courses formed from both elastic material and stretch-resistant material.

In some embodiments, knitted component 130 may include courses configured to impart various properties to upper 104 through the configuration of the courses. In some embodiments, courses may be configured to resist stretch. In some embodiments, a tensile course may be utilized to resist stretch. In some embodiments, a tensile course may incorporate large floated portions to resist stretch in particular areas of upper 104. In this Detailed Description, a floated portion refers to the piece of yarn or thread that joins one weft knitted loop or stitch to the next loop or stitch. Additionally, the tensile course may incorporate tuck stitches, minimizing the length of material used to form the tensile course. In other embodiments, the tensile course may incorporate a jersey loop.

As depicted, technical component 132 includes different stitches or loops in different areas of article 100. For example, referring to technical course 150, jersey loops are used from the sole portion to a lace portion of the upper. As shown, technical course 150 does not change its configuration based on location within upper 104. Rather, technical course 150 uses jersey loops or stitches throughout the length of technical course 150. In contrast, technical tensile course 152 utilizes different stitches depending on where in article 100 technical tensile course 152 is located. In the embodiment shown in FIGS. 1 and 2, technical tensile course 152 includes a large floated portion adjacent sole structure 102.

In some embodiments, courses may incorporate stitches or loops that are stretch resistant in an area of upper 104 that may experience higher magnitudes of force during use of article 100. In some embodiments, an area of upper 104 adjacent to the sole structure 102 may experience higher magnitudes of force during use of article 100 as opposed to other areas of article 100. As a user cuts or moves laterally, the foot of the user may press against the portion of upper 104 adjacent sole structure 102. In order to counteract the elevated levels of force in various locations within article 100, different configurations of stitches may be utilized. As shown in FIG. 1, stretch resistant area 140 of upper 104 is configured to resist stretch. In some embodiments, a jersey loop may be utilized along with a large floated portion to counteract elevated forces in this area. In other embodiments, a tuck stitch along with a large floated portion may be utilized to counteract the elevated forces that this area of upper 104 may experience during use of article 100. Additionally, by utilizing particular stitches, a foot may be restricted from movement within article 100, securing the foot in relation to the sole structure 102. As shown, technical tensile course 152 extends from sole structure 102 to instep area 122 and lace apertures 128. Technical tensile course 152 of knitted component 130 extends along the stretch resistant area 140 of upper 104 from a lower area 142 to an upper area 144. Adjacent sole structure 102 is lower area 142. Technical tensile course 152 utilizes a tuck stitch 160 in lower area 142. As technical tensile course 152 extends from lower area 142 to upper area 144, technical tensile course 152 utilizes a large floated portion 162. At upper area 144, technical tensile course 152 again utilizes another tuck stitch 164. Tuck stitch 160 and tuck stitch 164 may be used to secure large floated portion 162 of technical tensile course 152. In other embodiments, other types of loops such as jersey loops may be utilized. Detailed aspects relating to tuck stitches and floated portions will be discussed in detail later in the Detailed Description.

Although stretch resistant area 140 of upper 104 appears to be demarcated in FIG. 1, in some embodiments the stretch resistant area 140 of upper 104 may not be visually different than other areas of upper 104. In other embodiments, the stretch resistant area 140 of upper 104 may be demarcated indicating the location of stretch-resistant material. In other embodiments, the knit structure of stretch resistant area 140 of upper 104 may alter the appearance of stretch resistant area 140 such that when viewed, stretch resistant area 140 of upper 104 may be visually different than other areas of article 100.

Referring to FIG. 2, a lateral side view of article 100 is depicted. Additionally, enlarged portions of knitted component 130 incorporated into upper 104 of article 100 are shown. Referring to the enlarged portion 200, a swatch of knitted component 130 incorporating a jersey knit stitch is shown. It should be clear that although jersey stitch is shown throughout the Detailed Description, other stitches may be utilized.

Referring to enlarged portion 200, a jersey loop configuration is depicted. As shown, course 202 interacts and interloops with the loops of course 204. Both course 202 and course 204 are formed in a jersey loop orientation. Additionally, each course within enlarged portion 200 contributes to the width of the swatch.

Referring to enlarged portion 210, various stitches may be used to form enlarged portion 210. As shown, enlarged portion 210 includes at least two different types of stitches. Additionally, enlarged portion 210 is located in stretch resistant area 140 of upper 104. Enlarged portion 210 includes jersey loops as well as tuck stitches in combination with large floated portions. As shown, technical course 212 includes jersey loops that interact with jersey loops of technical course 214. In this manner, enlarged portion 210 is similar to enlarged portion 200. Additionally, floated portion 216 of technical tensile course 218 extends behind technical course 214. Tuck stitch 220 of technical tensile course 218 extends along loop 222 of technical course 212. Tuck stitch 220 therefore interacts with loop 224 of technical course 214 as well as loop 222 of technical course 212. In this manner, tuck stitch 220 does not increase the width of enlarged portion 210. Rather, tuck stitch 220 extends either into an interior void of article 100 or extends outward away from the interior void of article 100. Tuck stitch 220 and floated portion 216 therefore may add depth or thickness to enlarged portion 210. In other embodiments, technical tensile course 218 may include jersey loops. In such embodiments, the jersey loops may contribute to the width of enlarged portion 210.

Figure 3:
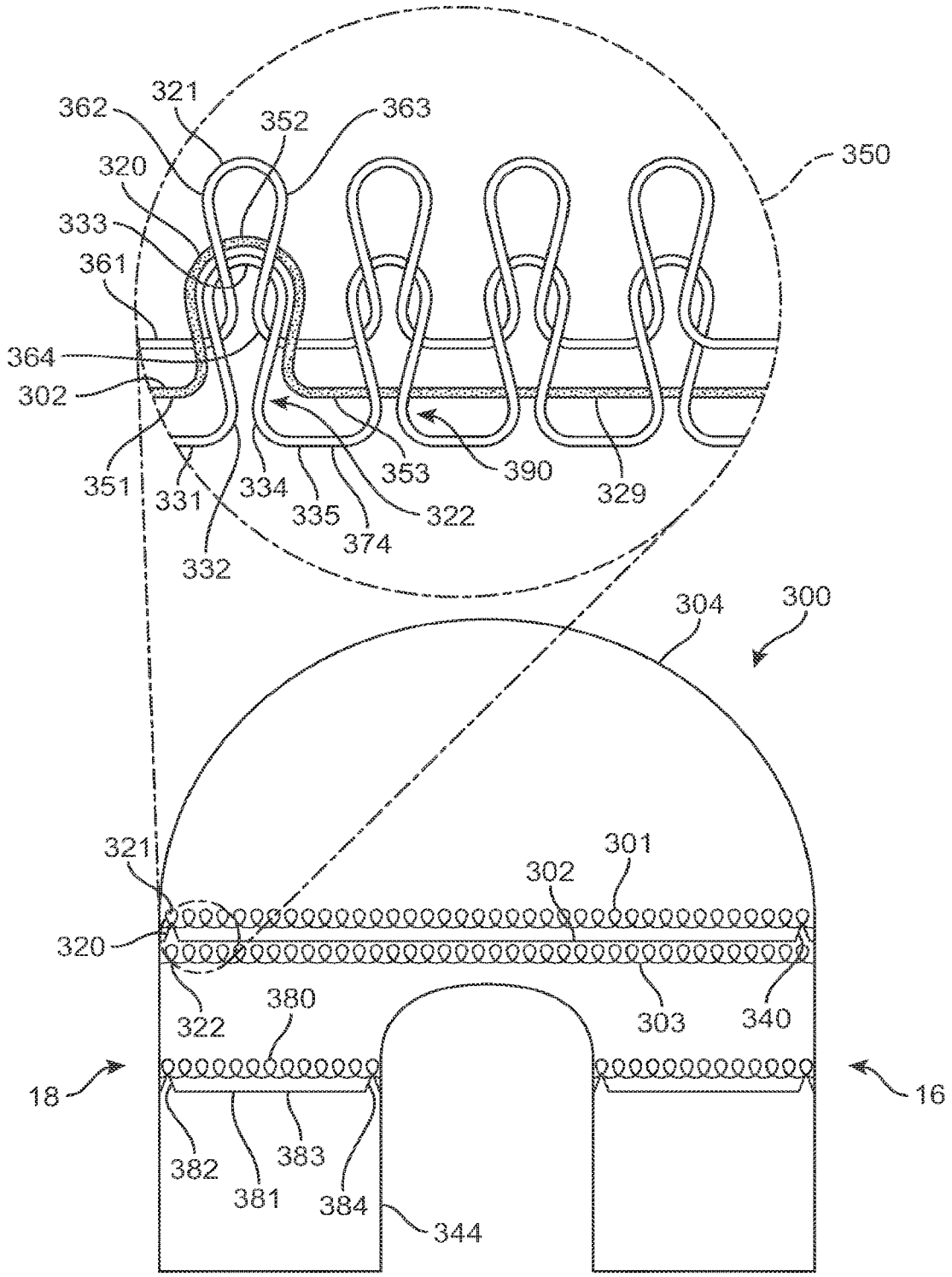
FIG. 3 is a schematic view of an embodiment of an upper incorporating a large floated portion and tuck stitches.

Referring to FIG. 3, a schematic view of an upper incorporating a knitted component including jersey stitches, tuck stitches, and large floated portions is depicted. Additionally, an enlarged portion of an upper is depicted that shows the interaction of various courses of the knitted component. Technical course 301, technical tensile course 302 and technical course 303 extend from medial side 18 to lateral side 16. Technical course 301 and technical course 303 depict jersey loop structures over the length of technical course 301 and technical course 303. Although depicted with few loops, it should be recognized that the number of loops in technical course 301 and in technical course 303 may be greater than the number of loops represented in FIG. 3. For example, technical course 301 and technical course 303 each may incorporate between ten loops and fifty or seventy-five or one hundred loops or more. Technical course 301 and technical course 303 of the knitted component incorporated into upper 300 extend generally across a vamp portion of upper 300.

Referring to upper 300, different locations of the knitted component incorporated into upper 300 may include large floated portions. Technical tensile course 302 of the knitted component extends generally across the vamp portion of upper 300. Technical tensile course 302, however, does not interact with technical course 301 and technical course 303 in the same way that technical course 301 and technical course 303 interact with each other. In some embodiments, technical tensile course 302 may include a tuck stitch located near perimeter edge 304 along medial side 18. The tuck stitch may be used to secure technical tensile course 302 from translating or slipping within the knitted component incorporated into upper 300. As shown, tuck stitch 320 is oriented to interact with loop 321 of technical course 301. Additionally, tuck stitch 320 may be layered or plaited with loop 322 of technical course 303. An enlarged view of the junction of tuck stitch 320 is depicted in enlarged portion 350. In other embodiments, technical tensile course 302 may include jersey loops. In such embodiments, technical tensile course 302 may interact with technical course 301 and technical course 303 in the same or similar manner that technical course 301 and technical course 303 interact with one another.

Technical course 303 as depicted includes multiple loops. Each of the loops interacts with loops of technical course 301. Loop 322 includes a foot 331, leg 332, head 333, leg 334, and foot 335. Leg 332 extends over foot 361 of loop 321. Head 333 extends behind leg 362 of loop 321, and additionally extends behind leg 363 of loop 321. Leg 334 of loop 322 extends over foot 364. In this manner loop 322 is interlooped with loop 321. Additionally, the strand that forms loop 322 extends from loop 322 to an additional loop 390 within technical course 303. This area is referred to as floated loop 374.

In some embodiments, a separate course may be interlooped between technical course 303 and technical course 301. In some embodiments, the course may interact with various loops in each of technical course 303 and technical course 301. In some embodiments, the separate course may interloop with particular loops of technical course 301 and technical course 303. As shown, tuck stitch 320 interloops with loop 321. Tuck stitch 320 may be visibly different than both loop 321 and loop 322. Tuck stitch 320, however, largely follows the same path as does loop 322. That is, leg 351 of tuck stitch 320 extends over foot 361 of loop 321. Additionally, head 352 passes behind leg 362 and leg 363 of loop 321. Further, leg 353 extends over foot 364 of loop 321. In this sense, tuck stitch 320 largely follows the path of loop 322. The floated portion of tuck stitch 320, however, does not extend toward an immediately adjacent loop. Rather, floated portion 329 extends behind loop 390 toward another tuck loop. Additionally, in contrast to loop 321 and loop 322, the legs of tuck stitch 320 do not intertwine with another loop. For example, loop 321 interloops with loop 322. Head 333 and leg 332 and leg 334 of loop 322 restrict the motion of loop 321 by limiting the movement of leg 362 and leg 363. In contrast, tuck stitch 320 is not interlooped with another loop that limits the motion of leg 351 and leg 353. This configuration is referred to as a tuck stitch. In other embodiments, a jersey loop may be incorporated on either side of floated portion 329 in contrast to the depiction of FIG. 3.

In some embodiments, the floated portion located in the tensile course may span or extend along many wales of the knitted component. "Wales" as used in this Detailed Description refers to the columns of loops that may extend along multiple courses. Wales extend perpendicular to the knitting direction. "Courses" refers to rows of loops formed from a strand that extend along the knitting direction. Additionally, some embodiments may refer to needles to discuss the width dimension. For example, a floated portion may extend over multiple needles of a knitting machine which may be holding loops. In other embodiments, the needles may not be holding loops. The distance that a floated portion extends through the knitted component may therefore be referred to as a needle width, measured in reference to the number of needles on the needle bed of the knitting machine, or needle, or may also be referred to in terms of number of wales of the knitted component. In some embodiments wales and needle widths may be interchangeable. However, in half-gauge configurations, a needle width of forty may correspond to a smaller distance than forty wales. That is because "wales" refers to the loops formed from the needles that may be altered, while "needle widths" refers to the width of needles that are located on a knitting machine. Reference may be made to various portions of courses extending over wales or needles in this Detailed Description.

In some embodiments, floated portion 329 may extend along technical course 303 passing multiple wales or needles while not interacting with loops of either technical course 301 or loops of technical course 303. In some embodiments, floated portion 329 may extend past ten wales. In other embodiments, floated portion 329 may extend past twenty wales. In still further embodiments, floated portion 329 may extend past seventy-five wales. In other embodiments, floated portion 329 may extend past a number of wales between about ten wales and about seventy-five wales.

In some embodiments, floated portion 329 may pass from one side of upper 300 to the other side of upper 300. By varying the length of floated portion 329, particularized stretch resistance may be achieved. For example, a floated portion that extends past ten wales may provide stretch resistance in a particularized area of a knitted component, while allowing another area of the knitted component to have elasticity. A floated portion that extends past seventy-five wales may provide stretch resistance over a greater portion of a knitted component. In other embodiments, a floated portion may extend over a portion of upper 300. In some embodiments, a floated portion may extend from a sole structure to an instep area.

The size of a stretch resistant area of an upper having a knitted component utilizing a tuck stitch and large floated portion configuration may correspond to the number of wales that a floated portion extends past or the widths of the needles that the floated portion extends past. For example, a floated portion that extends from lateral side 16 to medial side 18 of an article may extend past seventy-five wales. In contrast, a floated portion that extends from lateral side 16 to a central portion of an article may pass a fewer number of wales. Additionally, the size of a floated portion may correspond to the size and shape of the stretch resistant area. For example, an embodiment that includes a stretch resistant area associated with only a lateral side of an article may include a shorter or smaller floated portion than an embodiment that includes a stretch resistant area that extends from a lateral side to a medial side.

In some embodiments, technical tensile course 302 may include a mechanism for securing the course in place. In some embodiments, technical tensile course 302 may include another tuck stitch on the lateral side 16 of upper 300. Tuck stitch 340 may be another tuck stitch that is located on lateral side 16 of upper 300. Tuck stitch 340 may assist in securing the orientation of technical tensile course 302 with respect to technical course 301 and technical course 303 within the knitted component. Additionally, tuck stitch 340 may prevent technical tensile course 302 from unraveling and may lock the orientation of technical tensile course 302 in place within the knitted component. Tuck stitch 340 may be intertwined and interlooped with loops of technical course 301 and loops of technical course 303 in a similar manner as depicted in enlarged portion 350. Tuck stitch 320 and tuck stitch 340 may therefore secure technical tensile course 302 in place. Further, tuck stitch 320 and tuck stitch 340 may assist in securing floated portion 329.

In some embodiments, technical tensile course 302 may be formed from various materials. In some embodiments, technical tensile course 302 may be formed from a stretch-resistant material. In some embodiments, the stretch-resistant material may have a high tensile strength. In some embodiments, the stretch-resistant material may comprise Kevlar, carbon fiber, or other materials.

Referring to upper 300, other areas of upper 300 may include portions of knitted component having courses incorporating large floated portions in combination with jersey loop formations and stitches. In some embodiments, floated portions may extend from a first side of an upper to an interior edge 344. In some embodiments, interior edge 344 may define ankle opening 118. Additionally, interior edge 344 may define an area encompassing a tongue portion of upper 300. In some embodiments, lace apertures 128 may be located adjacent interior edge 344. For example, technical course 381 extends from medial side 18 to interior edge 344. As depicted, technical course 381 includes a first tuck stitch 382 adjacent perimeter edge 304. A second tuck stitch 384 is located adjacent interior edge 344. A floated portion 383 extends from first tuck stitch 382 to second tuck stitch 384. In some embodiments, floated portion 383 may not interloop with loops of adjacent technical course 380. In some embodiments, a large floated portion such as floated portion 383 may be used to control stretch in a midfoot area within an article of footwear.

Comparing floated portion 383 to floated portion 329, there is a difference in the length of floated portion 383 and floated portion 329. Floated portion 329 extends from medial side 18 to lateral side 16 of article 300. In this configuration, floated portion 329 may resist stretch along floated portion 329 from medial side 18 to lateral side 16. Floated portion 383, by comparison extends from medial side 18 to interior edge 344. In this configuration floated portion 383 may resist stretch over a shorter distance. Additionally, floated portion 383 extends past a fewer number of wales than does floated portion 329. Therefore, the length of the floated portions may be adjusted for a particular stretch-resistant property in a particular area within an article.

In some embodiments, an article may include different areas of stretch resistance. In some embodiments, a first area or zone may be configured to resist stretch and a second area may be configured to be more flexible or stretchable than the first area. In some embodiments, the first area may incorporate large floated portions, and the second area may incorporate a different combination of stitches and loops. Thus, in some embodiments, areas with floated portions can have higher stretch resistance than areas with stitches and loops. However, in some embodiments, the article can include an area with large floated portions and other areas with stitches and loops, wherein both areas substantially resist stretching.

Furthermore, in some embodiments, the first area may incorporate a greater number of floated portions than the second area causing the areas to have different stretch resistances from each other. In some embodiments, the first area may be more resistant to stretch than the second area due to the greater overall length of floated portions in the first area. Also, the stretch resistance of each area may be determined by the orientation and placement of the floated portions throughout the first area and the second area.

In other embodiments, the area or distance encompassed by floated portions in the first area may be larger than the area or distance encompassed by floated portions in the second area. For example, in some embodiments, the first area may include a floated portion that extends over ten needles widths. The second area may include two floated portions that each extends over two needle widths. In this configuration, the two floated portions of the second area extend over a total of four needle widths. In this configuration, the floated portion of the first area that extends over ten needles widths encompasses a greater distance or area than the two floated portions that each extends over two needle widths.

Figure 4:
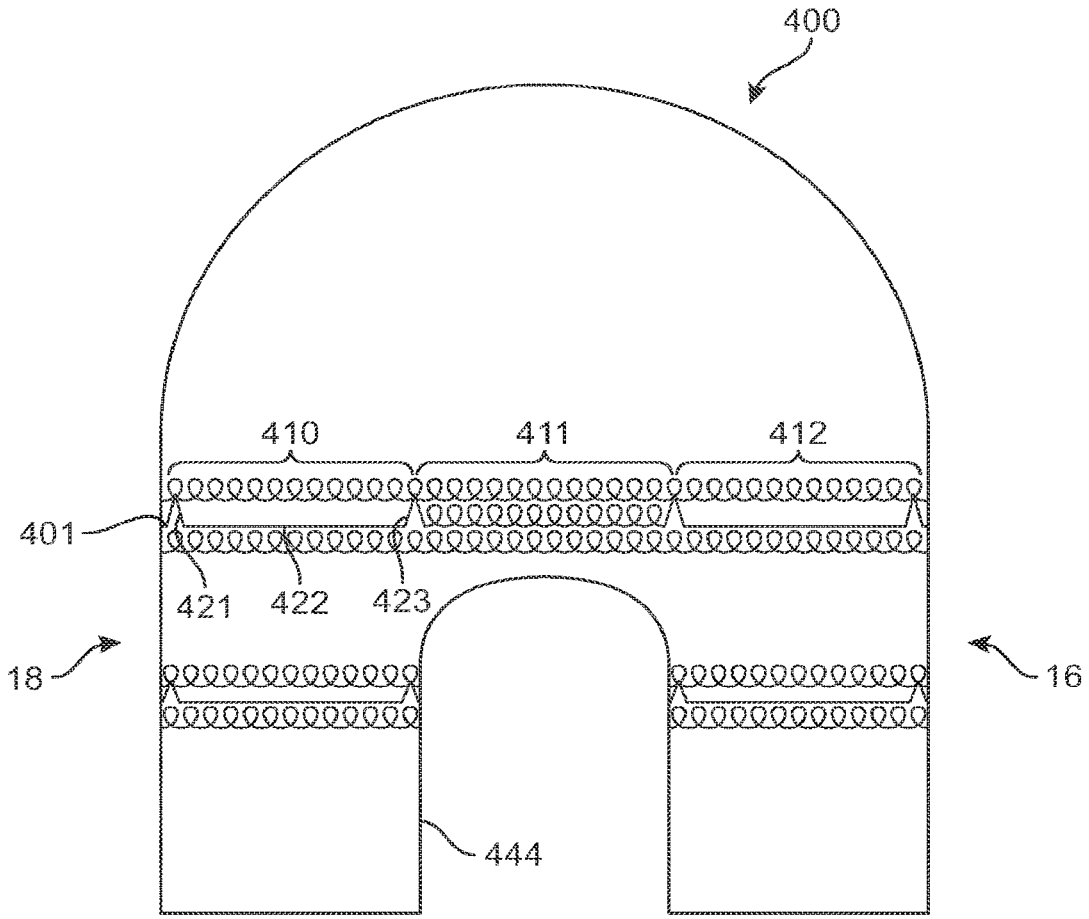
FIG. 4 is a schematic view of an embodiment of an upper incorporating tuck stitches and large floated portions.

Referring to FIG. 4, an alternate embodiment of an upper is depicted. As shown, large floated portions extend from medial side 18 toward interior edge 444. Additionally, large floated portions extend from lateral side 16 toward interior edge 444. This is similar to the configuration as depicted in upper 300 in FIG. 3.

In some embodiments, a tensile course may have varying configurations. In some embodiments, a tensile course may include a floated portion that extends from one side of an upper to another side of the upper. In other embodiments, the tensile course may include a floated portion that extends partly across an upper, and also incorporates jersey loops or other loops. Various combinations of floated portions and other loops may be combined within the tensile course to achieve a particular stretch resistance in particular locations. By varying the type of stitch or loop configuration within the tensile course, the properties of stretch resistance may be varied through each individual course. By varying the type of stitch, flexibility in design may be achieved because each strand need not have the same properties along each course. For example, a course may be stretch resistant in a first region, and elastic in a second region. Technical tensile course 401, for example, has various knit loop configurations as the strand that forms technical tensile course 401 extends from medial side 18 to lateral side 16.

Upper 400 may be separated into regions in order to aid in the description of the components of upper 400. The regions are not meant to be a precise demarcation; rather the regions are used for convenience is describing upper 400. Each course may be split into different regions for purposes of this discussion: medial region 410, central region 411 and lateral region 412. Medial region 410 of technical tensile course 401 may include a tuck stitch 421, a large floated portion 422, and another tuck stitch 423. Central region 411 of technical tensile course 401 may include a plurality of jersey loops as well as other loop configurations. Lateral region 412 of technical tensile course 401 may be configured similarly to medial region 410.

As depicted, medial region 410 may be configured to resist stretch. The combination of tuck stitches and a large floated portion may allow for this region of technical tensile course 401 to resist stretching. Referring to central region 411, jersey loops are utilized. Central region 411 may be therefore configured to allow for stretch. Additionally, lateral region 412 may be configured for stretch-resistance. As depicted, technical tensile course 401 therefore includes three regions with differing loop configurations to provide different levels of support and stretch-resistance to the knitted component incorporated into upper 400. In this configuration stretch is limited along lateral side 16 and stretch is limited along medial side 18. Additionally, a central portion of upper 400 may be configured to stretch to a greater degree than medial region 410 and lateral region 412 when subjected to the same tensile force.

In some embodiments, the central region of the tensile course may be varied in size. In some embodiments, central region 411 may be wide and encompass a greater percentage of technical tensile course 401. In such embodiments, a greater portion of technical tensile course 401 may be stretchable. By varying the size of central region 411, the relative sizes of medial region 410 and lateral region 412 may be altered. By increasing the size of central region 411, the size of medial region 410 and the size of lateral region 412 may be reduced. The smaller size of medial region 410 and lateral region 412 may form smaller areas of stretch resistance in upper 400. In other embodiments, central region 411 may be reduced. In such embodiments, medial region 410 and lateral region 412 may be increased and form larger areas of stretch resistance in upper 400. By varying the relative size of different regions of technical tensile course 401 within upper 400, different levels of stretch resistance may be located over different distances of a tensile course.

Additionally, by varying the length of floated portions within technical tensile course 401, various stretch-resistant zones or areas may be formed. For example, floated portion 422 extends from medial side 18 toward central region 411. In other embodiments, floated portion 422 may extend into central region 411 and provide stretch resistant within central region 411. In other embodiments, floated portion 422 may extend over a fewer number of wales and provide stretch resistance over a portion of medial region 410. The size of each stretch-resistant area may be configured by allowing floated portion 422 to pass over greater or fewer wales during the manufacturing process.

Figure 5:
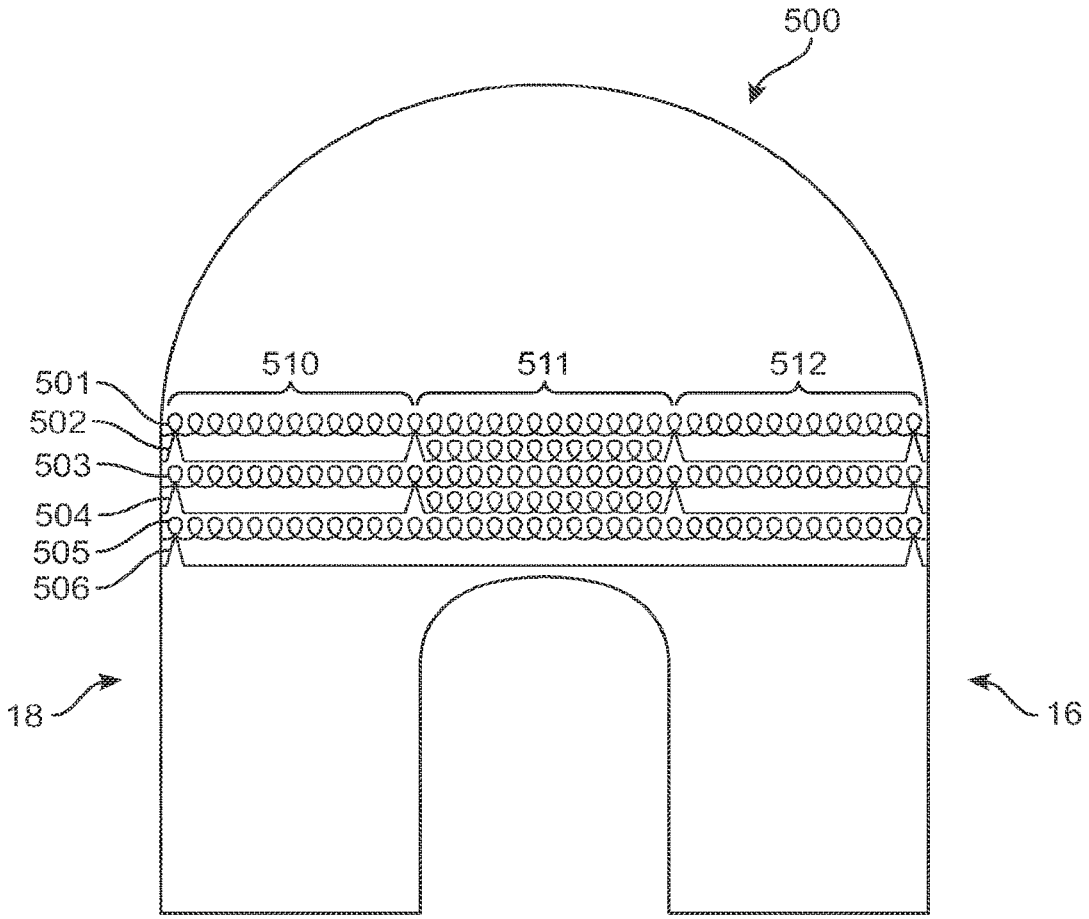
FIG. 5 is a schematic view of an alternate embodiment of an upper incorporating tuck stitches and large floated portions.

Referring to FIG. 5, an alternate embodiment of an upper incorporating large floated portions is depicted. In this embodiment, multiple tensile courses are incorporated into a vamp area of upper 500. As shown, upper 500 includes technical course 501, technical tensile course 502, technical course 503, technical tensile course 504, technical course 505 and technical tensile course 506. Technical course 501, technical course 503 and technical course 505 are all configured using jersey loops from medial side 18 across upper 500 to lateral side 16. Technical tensile course 502, technical tensile course 504, and technical tensile course 506 incorporate tuck stitches and large floated portions. Some of the tensile courses also include jersey loops. Various configurations of tensile courses may be utilized in conjunction with one another in order to achieve different stretch-resistant properties in different areas of upper 500.

Upper 500 may be separated into regions in order to aid in the description of the components of upper 500. The regions are not meant to be a precise demarcation; rather the regions are used for convenience is describing upper 500. Lateral region 512 may refer to an area located on the lateral side of upper 500. Central region 511 refers to a middle portion of upper 500 that extends between lateral region 512 and medial region 510. Medial region 510 refers to an area located on the medial side of upper 500.

Referring to technical tensile course 502 and technical tensile course 504, each tensile course is configured in a similar manner as technical tensile course 401 as depicted in FIG. 4. That is, technical tensile course 502 and technical tensile course 504 each include a tuck stitch adjacent medial side 18 of upper 500. A floated portion extends from medial side 18 toward central region 511. Technical tensile course 502 and technical tensile course 504 additionally include a second tuck stitch located adjacent central region 511. Technical tensile course 502 includes jersey loops in central region 511. Technical tensile course 502 additionally includes a tuck stitch adjacent lateral side 16. A floated portion extends from the tuck stitch toward central region 511 where another tuck stitch is located. The tuck stitch on either side of lateral region 512 may secure technical tensile course 502 in a particular orientation with respect to other courses and upper 500.

Upper 500 may additionally incorporate a knitted component having other tensile courses arranged in different configurations. For example, technical tensile course 506 may include a different configuration of tuck stitches and floated portions than the configuration of technical tensile course 504 and the configuration of technical tensile course 502. As shown, technical tensile course 506 includes a tuck stitch adjacent to medial side 18. Another tuck stitch is located adjacent to lateral side 16. A larger floated portion extends from the first tuck stitch to the second tuck stitch when compared to the floated portions of technical tensile course 502 and technical tensile course 504. The configuration of technical tensile course 506 may provide greater stretch resistance over the entire width of article 500 than compared with technical tensile course 502 and technical tensile course 504.

The configuration of upper 500 depicts the use of various configurations of tensile courses within a single upper. By varying the configuration of tensile courses throughout a knitted component, different areas of upper 500 may have different levels of stretch resistance. The tensile courses can be configured to resist stretch within desired locations of upper 500.

In some embodiments, technical tensile course 502, technical tensile course 504 and technical tensile course 506 may be formed from a continuous strand. In other embodiments, the various tensile courses may be formed from individual strands. For example, the strand that forms technical tensile course 506 may extend out of article 500 and continue as technical tensile course 504. In other embodiments, each technical course may be a separate strand.

Figure 6:
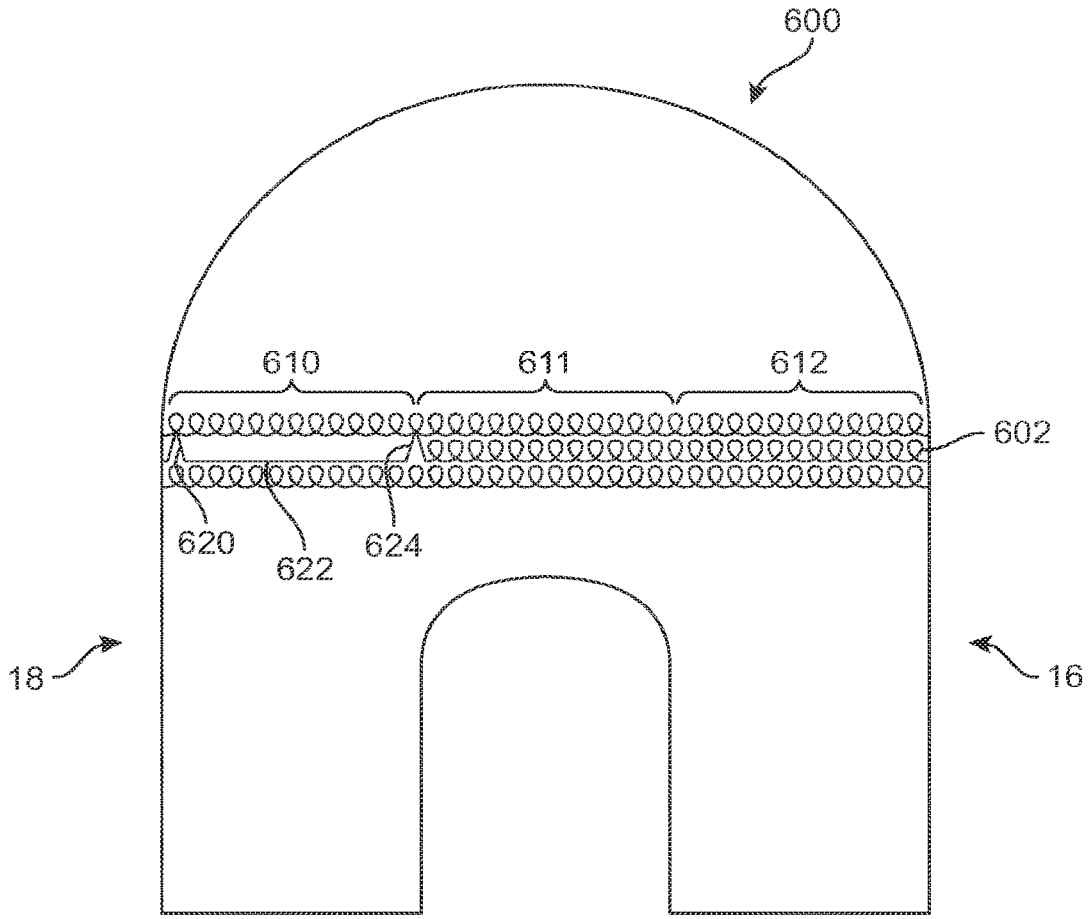
FIG. 6 is a schematic view of an alternate embodiment of an upper incorporating tuck stitches and large floated portions.

Referring to FIG. 6, an alternate embodiment of an upper incorporating a knitted component having a large floated portion is depicted. Upper 600 may be separated into regions in order to aid in the description of the components of upper 600. The regions are not meant to be a precise demarcation; rather the regions are used for convenience is describing upper 600. Medial region 610 may refer to an area located on the medial side of upper 600. Central region 611 refers to a middle portion of upper 600 that extends between medial region 610 and medial region 610. Lateral region 612 may refer to an area located on the lateral side of upper 600.

In some embodiments, particular regions of upper 600 incorporating a knitted component may incorporate large floated portions to resist stretch. In some embodiments, the floated portion may extend from one region to another region. In other embodiments, the floated portion may be formed in a single region. As depicted in FIG. 6, the knitted component of upper 600 includes technical tensile course 602. Technical tensile course 602 incorporates tuck stitch 620 adjacent to medial side 18. Tensile course additionally includes tuck stitch 624 adjacent central region 611. Floated portion 622 extends between tuck stitch 620 and tuck stitch 624. From central region 611 to lateral region 612, technical tensile course 602 is formed from jersey loops. In this configuration, technical tensile course 602 may be configured to resist stretch in medial region 610 while allowing for other areas of upper 600 to stretch to a greater degree.

The configuration of the knitted component incorporated into upper 600 may be used to counteract typical forces that may be exerted throughout upper 600 during use. Typical forces are forces that may occur in an article of footwear that is used for a particular purpose, for example, an article of footwear configured for a sport or other athletic activity. The typical motions for a player or participant of a sport or athletic activity cause force to be exerted on an upper of the article in certain areas. Typical forces may be forces that extend through an article as a foot presses against upper 600. The foot may stretch or deform upper 600 as the foot extends into upper 600. By placing large floated portions in particular locations in the knitted component incorporated into the upper, the floated portions may be used to counteract the forces from a foot and assist with securing the foot within the article of footwear and resist deformation of upper 600.

Figure 7:
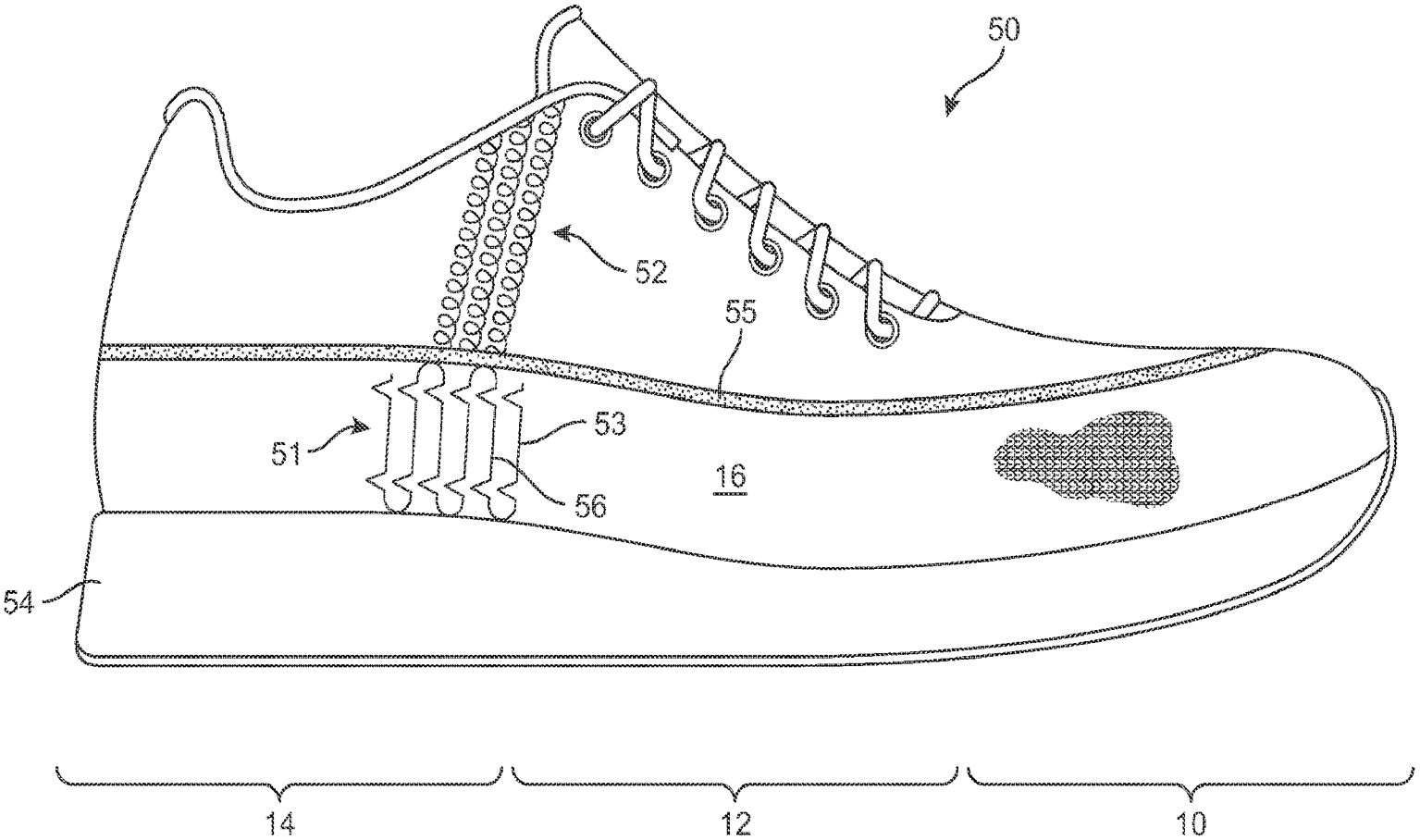
FIG. 7 is a schematic view of an embodiment of an article of footwear incorporating large floated portions.
Figure 8:
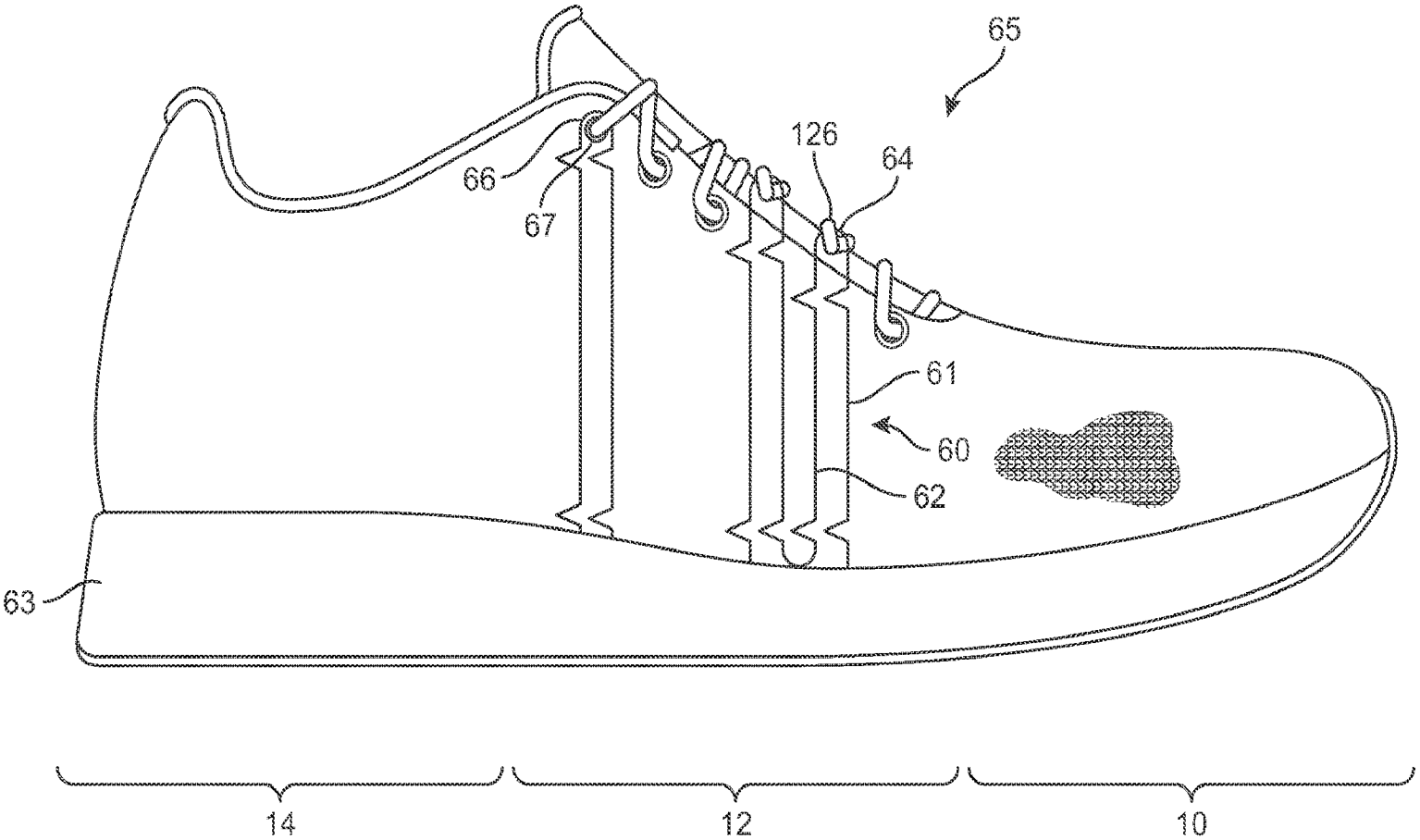
FIG. 8 is a schematic view of an alternate embodiment of an article of footwear incorporating large floated portions.
Figure 9:
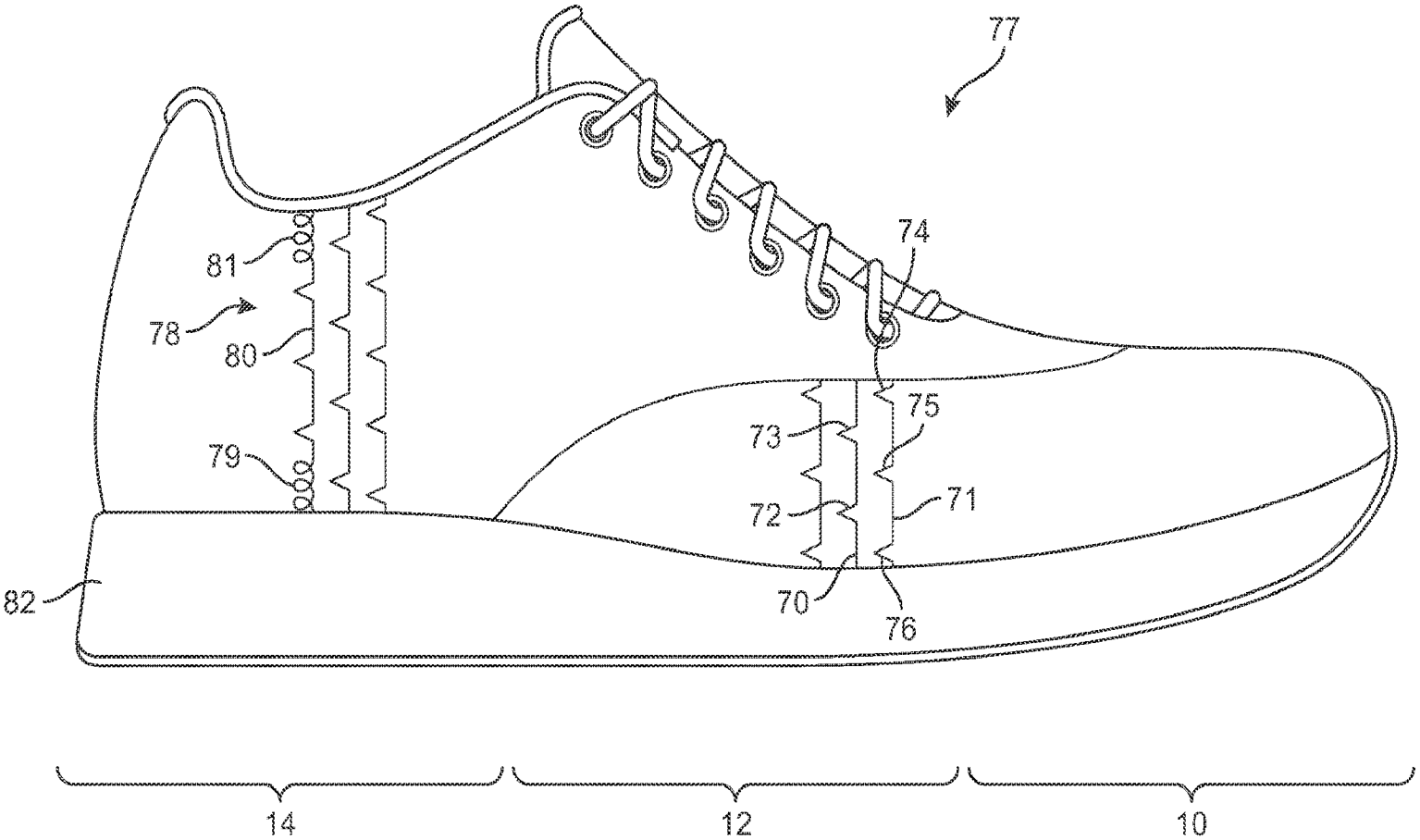
FIG. 9 is a schematic view of an alternate embodiment of an article of footwear incorporating large floated portions.

Referring to FIGS. 7-9, various articles of footwear are depicted that incorporate different configurations of floated portions. Although each of the articles depicted includes areas that do not show jersey loops, or other loops, it should be recognized that the floated portions of each of the articles may interact with adjacent loops as depicted in the previous Figures. Referring particularly to FIG. 7, an article of footwear 50 is depicted incorporating large floated portions along a lateral side 16. It should be recognized that although depicted along lateral side 16, floated portions may be oriented along medial side 18 or within other areas of article 50. Area 51 that incorporates the large floated portions may be configured to resist stretch. Additionally, area 52 may include a different knit structure than area 51. In some embodiments, area 52 may be configured to allow for greater stretch than area 51. In some embodiments, area 52 may include jersey loops or other various loops.

Referring to floated portion 53, floated portion 53 may extend from sole structure 54 to a joining area 55. Joining area 55 may represent the area between area 51 that is configured for stretch resistance and area 52 that is configured to be less stress resistant than area 51. In some embodiments, joining area 55 may have some of the characteristic of area 51 and some of the characteristics of area 52. For example, in some embodiments, joining area 55 may incorporate portions of the floated portions of area 51 as well as some portions of a jersey knit or other knit configuration of area 52.

In some embodiments, floated portions of area 51 may be formed of a single thread or yarn. For example, floated portion 53 may be formed from the same thread that is floated portion 56. In other embodiments, floated portion 53 and floated portion 56 may be formed from separate yarns or thread.

Referring to FIG. 8, an alternate embodiment of an article that incorporates a knitted component is depicted. In some embodiments, a portion of the knitted component may interact with laces of an article of footwear. As depicted in FIG. 8, lace 126 extends through a loop formed by tensile strand 60. In some embodiments, tensile strand 60 may be used to form floated portion and floated portion 62. In some embodiments, tensile strand 60 may extend from sole structure 63 toward an ankle opening or instep area.

In some embodiments, a portion of tensile strand 60 may extend away from the exterior surface of the knitted component. That is, in some embodiments, loop 64 may extend out of the surface of the knitted component incorporated into article 65. In some embodiments, lace 126 may extend through loop 64. In some embodiments, lace 126 may extend through multiple loops.

In some embodiments, a tensile strand may form a loop within the knitted component. For example, loop 66 may be positioned within the knitted component incorporated into article 65. In some embodiments, loop 66 may extend around a lace aperture 67. In some embodiments, lace 126 may pass through lace aperture 67.

In the configuration depicted in FIG. 8, loops form by tensile strands may assist in tightening and adjusting the fit and feel of article 65 as lace 126 is adjusted. As lace 126 is tightened, the tensile strand may also tighten and cause the upper of article 65 tighten.

Referring to FIG. 9, in some embodiments, tensile courses may utilize specific configurations. In some embodiments, tensile courses may be arranged such that junctions are not aligned with one another. For example, in some embodiments, adjacent tensile courses may be oriented such that the loops of adjacent tensile courses are not aligned with each other. In some embodiments, as a floated portion extends over multiple needle widths, the floated portion may move or slide along the knitted component. In some embodiments, the floated portions may be able to be snagged or caught on an external item. In order to avoid the tensile courses from becoming snagged, additional loops may be integrated into the floated portions to reduce the length of the floated portions.

In some embodiments, the loops or tuck stitches that secure floated portions may be specifically located within each tensile course. When tensioned, tensile courses may extend a small amount around the area of each tensile course that includes a loop or tuck stitch. By varying the location of each of the tuck stitches or loops that are used to secure tensile courses, the stretch resistance of the tensile courses may be controlled. For example, referring to tensile course 70, tensile course 70 includes a first tuck stitch 72 and a second tuck stitch 73. Located adjacent tensile course 70 is tensile course 71. Tensile course 71 includes third tuck stitch 74, fourth tuck stitch 75, and fifth tuck stitch 76. As shown in FIG. 9, first tuck stitch 72 and second tuck stitch 73 are offset from third tuck stitch 74, fourth tuck stitch 75, and fifth tuck stitch 76. For example, first tuck stitch 72 may be located in a first wale position. The wale position refers to the loop location along the course with respect to the needles used to form each loop. Fourth tuck stitch 75 may be located in a second wale position that is different than the first wale position. That is, the needle used to form fourth tuck stitch 75 may be different than the needle used to form first tuck stitch 72. In this configuration, therefore, fourth tuck stitch 75 and first tuck stitch 72 may be offset from one another.

In this configuration, as tensile course 76 and tensile course 70 are subjected to a force, each of the tensile courses may stretch or extend at different locations. By offsetting the loops or tuck stitches within each tensile course, the areas when each tensile course may stretch may be spread out. For example, there may not be a concentrated portion of the stretch-resistant area of the knitted component integrated into article 77 that may stretch or extend. By varying the location of each of the loops or tuck stitches, the stretch of the tensile courses may be muted, less noticeable, or spread over a larger portion of the stretch-resistant area.

In some embodiments, a floated portion may be located adjacent to jersey loops or other loops within the knitted component integrated into article 77. For example, in some embodiments, a floated portion may not extend directly from a sole structure or direction across an article of footwear. Tensile course 78 includes a jersey loop portion 79, a floated portion 80, and another jersey loop portion 81. As shown, floated portion 80 does not extend directly from sole structure 82 and additionally does not extend completely to the ankle opening of article 77. In this configuration, floated portion 80 may resist stretch while jersey loop portion 79 and jersey loop portion 81 may be more stretchable than floated portion 80. Additionally, other portions such as jersey loop portion 79 and jersey loop portion 81 may be utilized to offset the tuck stitches or other loops between adjacent tensile courses or other courses. By utilizing the jersey loop portions in conjunction with floated portions, the areas of stretch within adjacent floated portions may be reduced.

Figure 10:
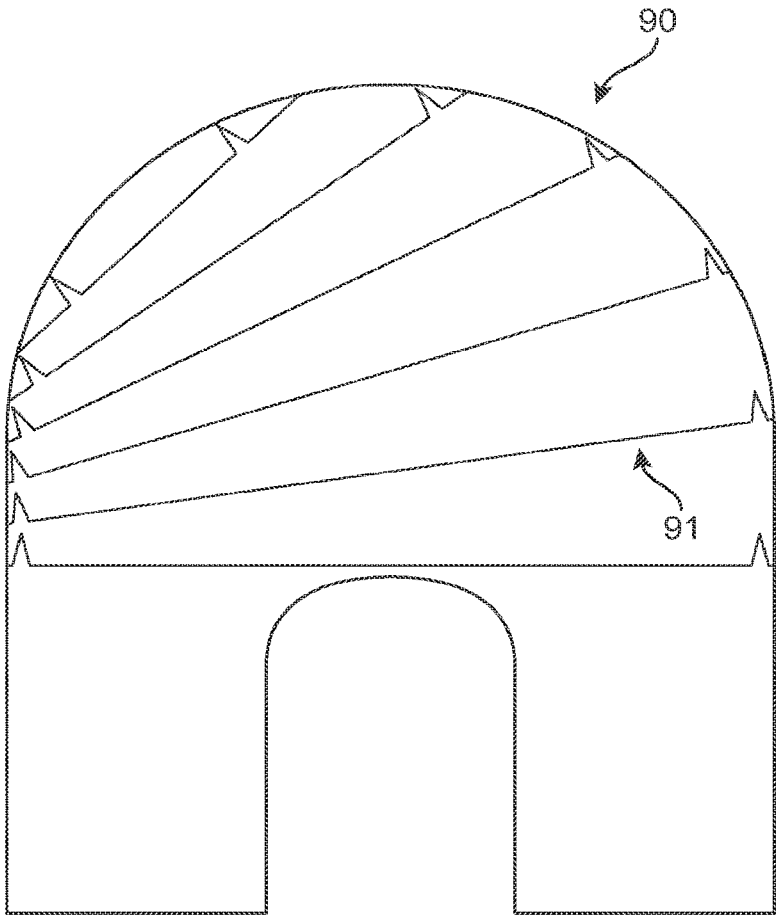
FIG. 10 is a schematic view of an embodiment of a knitted component incorporating large floated portions.
Figure 11:
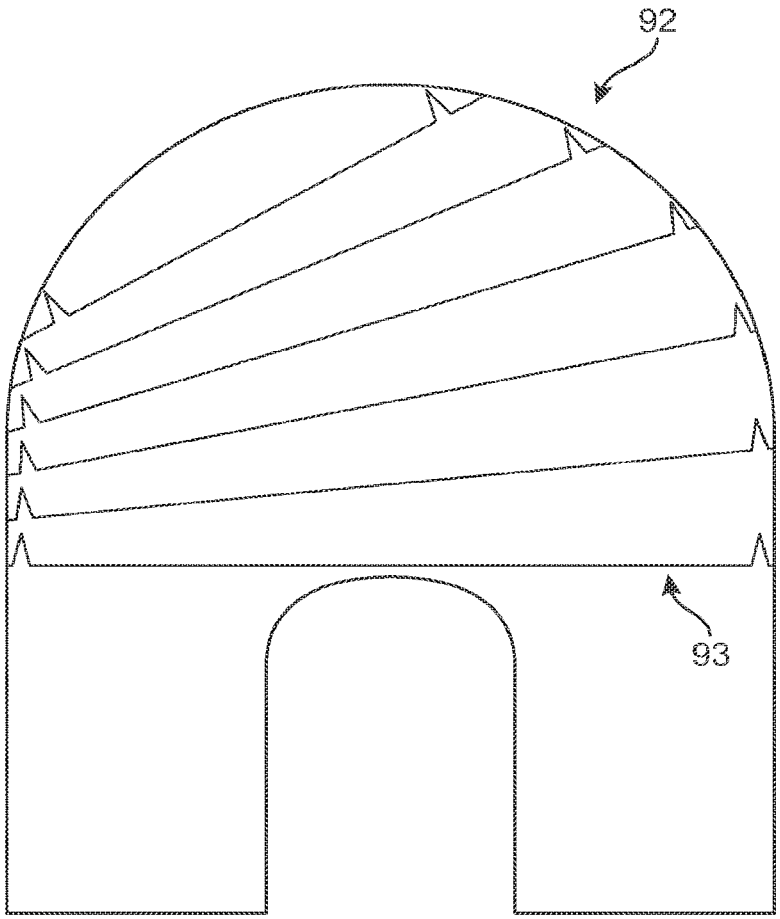
FIG. 11 is a schematic view of an alternate embodiment of a knitted component incorporating large floated portions.
Figure 12:
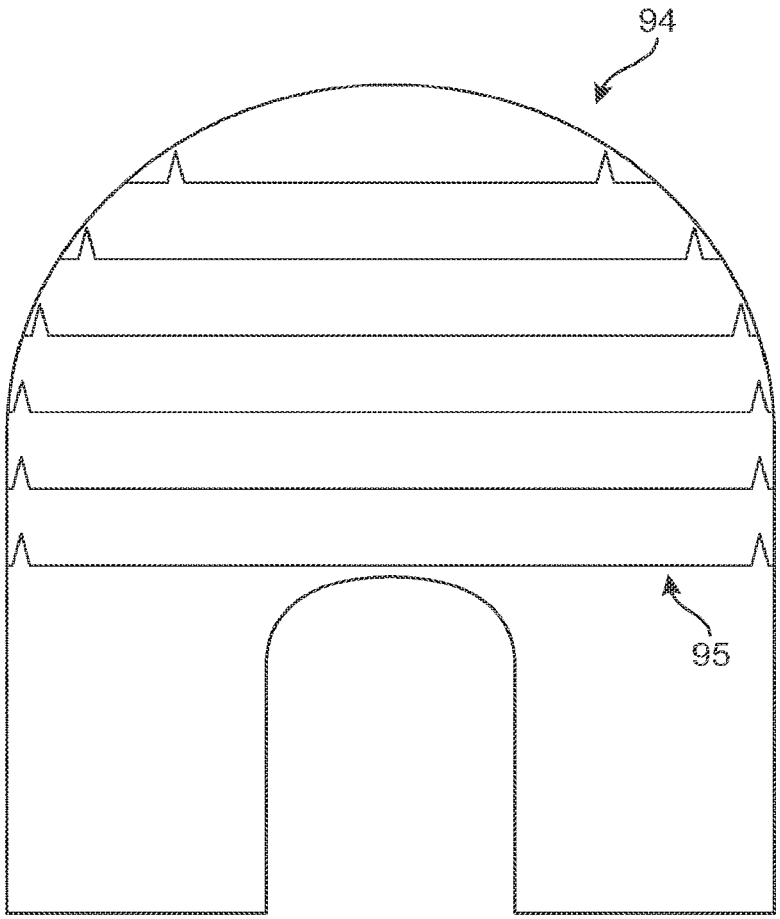
FIG. 12 is a schematic view of an alternate embodiment of a knitted component incorporating large floated portions.

Referring to FIGS. 10-12 various configurations of tensile courses incorporated into knitted components are depicted. In some embodiments, tensile courses may be oriented in order to counteract or direct forces that particular articles of footwear may experience during normal use. For example, a wearer participating in football may cut laterally during normal play such that particular forces may be exerted upon the upper of an article of footwear. In other embodiments, an article used for playing basketball may include tensile courses oriented at different angles to counteract the forces that may be exerted upon the upper during use. Additionally, an article designed for track or running may include tensile courses oriented at other angles.

Referring to FIG. 10, tensile courses 91 of knitted component 90 may angle around a vamp area of knitted component 90. In this embodiment, tensile courses 91 may be oriented to counteract particular lateral and vertical forces. Referring to FIG. 11, knitted component 92 includes tensile courses 93 that are oriented differently than the tensile courses of knitted component 90. In this depiction, tensile courses 93 may be oriented at less of an angle than the tensile courses of knitted component 90. The tensile courses may be orientated at various angles depending on the type of sport or activity the article is designed for. Referring to FIG. 12, knitted component 94 is depicted and includes tensile courses 95. Knitted component 94 may be incorporated into an article that may be used for track or for running. As running does not typically involve a cutting motion, tensile course 95 may extend laterally.

The embodiments described herein can make use of any of the apparatus or structures described in Meir, U.S. Pat. No. 9,661,892, filed as U.S. application Ser. No. 14/445,835 on Jul. 29, 2014 and entitled "Article of Footwear Incorporating an Upper with a Shifted Knit Structure," the entirety of which is hereby incorporated by reference.

Referring to FIGS. 13-16, various stitch configurations are depicted. Tensile technical tensile course 302 and technical course 301 from upper 300 are depicted in isolation from other courses within upper 300. Technical tensile course 302 includes tuck stitch 320 and tuck stitch 340. Floated portion 329 extends between and connects tuck stitch 320 to tuck stitch 340. In contrast, technical course 301 includes a plurality of loops 910. FIGS. 13-16 are used to demonstrate the relative length of each of the courses within upper 300.

Figure 13:
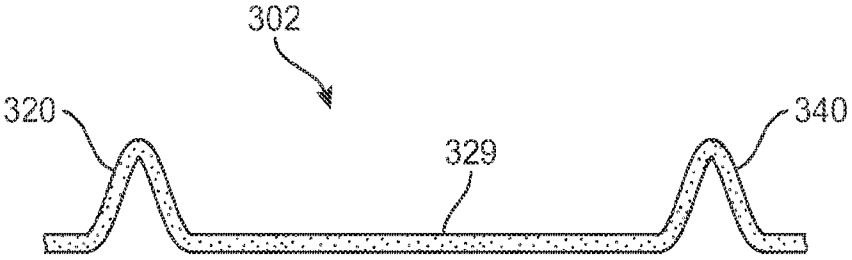
FIG. 13 is a view of an embodiment of a course incorporating a tuck stitch and large floated portions.
Figure 14:
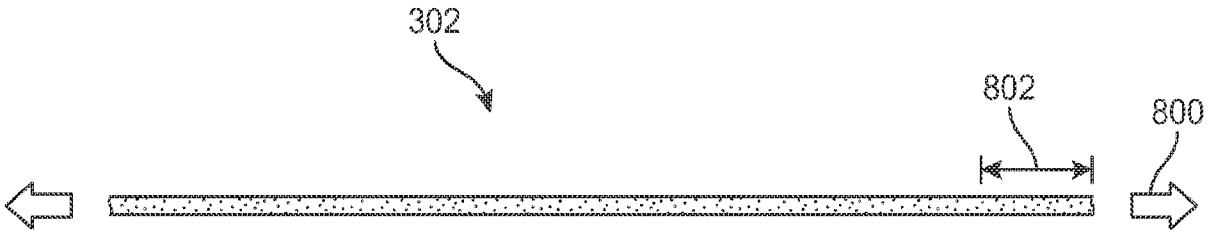
FIG. 14 is a schematic view of a technical tensile course subjected to a tensile force.

Referring to FIG. 13, technical tensile course 302 is depicted in isolation from other courses of the knitted component incorporated into upper 300. Technical tensile course 302 includes tuck stitch 320, floated portion 329 and tuck stitch 340. As technical tensile course 302 is subjected to a tensile force 800, the length of technical tensile course 302 may extend. As depicted in FIG. 14, technical tensile course 302 is fully expanded to the full length of the strand that forms technical tensile course 302. In this configuration, tuck stitch 320 and tuck stitch 340 are flattened. The yarn or material from the tuck stitches extends the length of technical tensile course 302 a distance 802.

It should be recognized that along with the physical and geometric configuration of technical tensile course 302, changing the material properties of the strand may contribute to the stretchability of each course. For example, by using a stretchable material, tensile technical course 302 may be able to extend a greater distance than distance 802. Unless otherwise specified in this Detailed Description, when discussing the distance that a configuration may extend this Detailed Description relates to the physical or geometric configuration of structure rather than the material properties of the material used to form the structure.

Due to the geometric configuration of technical tensile course 302, floated portion 329 encompasses a large percentage of technical tensile course 302. Because floated portion 329 encompasses a large percentage of technical tensile course 302, when subjected to tension, technical tensile course 302 does not extend by a large degree. Floated portion 329 in a non-tensioned state is a generally straight area of technical tensile course 302 that does not include additional loops. Therefore, when technical tensile course 302 is tensioned, floated portion 329 does not add to the length of technical tensile course 302. The extension of technical tensile course 302 to a flat linear course as depicted in FIG. 14 is used as a representation to depict the amount of yarn used to form technical tensile course 302 in comparison to other courses. It should be recognized that during use within an upper, technical tensile course 302 may not fully extend to a completely linear configuration as depicted in FIG. 14; rather, technical tensile course 302 may extend a lesser amount than other courses that have different configurations. For example, technical tensile course 302 may extend a lesser amount than technical course 301 when subjected to an equal force.

Figure 15:
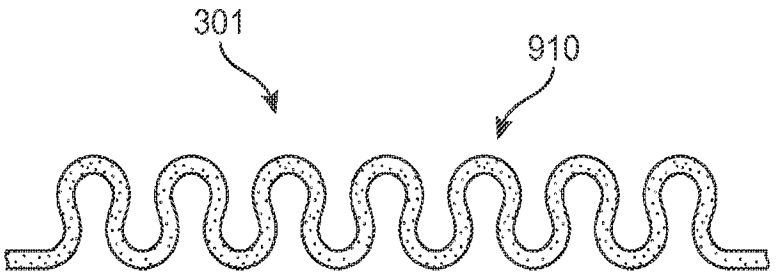
FIG. 15 is a schematic view of an embodiment of a course incorporating multiple loops.
Figure 16:
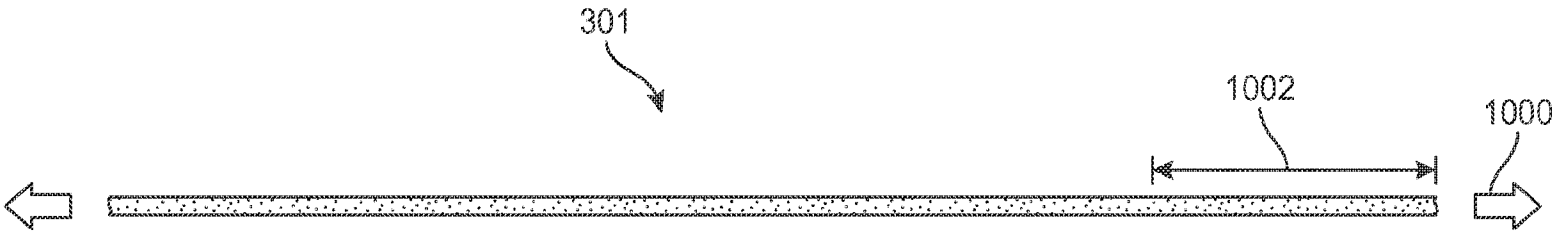
FIG. 16 is a schematic view of a technical course subjected to a tensile force.

Referring to FIGS. 15 and 16, technical course 301 is depicted in isolation in a tensioned state and a non-tensioned state. In FIG. 15, technical course 301 is in a non-tensioned state. In contrast, in FIG. 16, technical course 301 is subjected to a tensile force 1000. As shown, technical course 301 extends a distance 1002 when subjected to tensile force 1000. As technical course 301 is subjected to tensile force 1000, the strand or material used to form plurality of loops 910 is flattened and contributes to the length of technical course 301. Because there are a large number of loops in technical course 301, the length of technical course 301 may increase a large amount in comparison to technical tensile course 302. For example, distance 1002 may be larger than distance 802. When used in conjunction with other jersey loops, a course of the configuration of technical course 301 may be relatively elastic. Technical tensile course 302, by contrast, uses a fewer number of loops. Therefore, technical tensile course 302 may form a course that is relatively stretch resistance compared to technical course 301. As discussed with relation to technical tensile course 302, tensile course 301 may not completely flatten when incorporated into an upper as depicted in FIG. 16; rather, the loops of technical course 301 may diminish in size and contribute to the length of technical course 301.

In some embodiments, tensile courses may be used in conjunction with jersey loop courses. By using tensile courses in conjunction with jersey loop courses, the stretch of the jersey loop courses may be controlled and limited. For example, by interacting and interlooping technical tensile course 302 with technical course 301, the stretchability of technical course 301 may be limited. As interlooped technical tensile course 302 and technical course 301 are subjected to a tensile force, each may begin to extend. Because technical tensile course 302 may extend a shorter distance than technical course 301, technical tensile course 302 may restrict technical course 301 from extending a large distance. For example, the maximum distance that the combined course of technical course 301 and technical tensile course 302 may extend based on the physical and geometric configuration of the combined course is distance 802. The reason for this property is because technical tensile course 302 cannot draw on any additional loops beyond tuck stitch 320 and tuck stitch 340 to extend the length of technical tensile course 302. Although technical course 301 may be able to extend a greater amount in isolation, by interacting technical tensile course 302 with tensile course 301, the distance that tensile course 301 is able to extend may be limited by technical tensile course 302. In this manner, technical tensile courses may be used throughout an article or component to limit stretch in particular areas.

Figure 17:
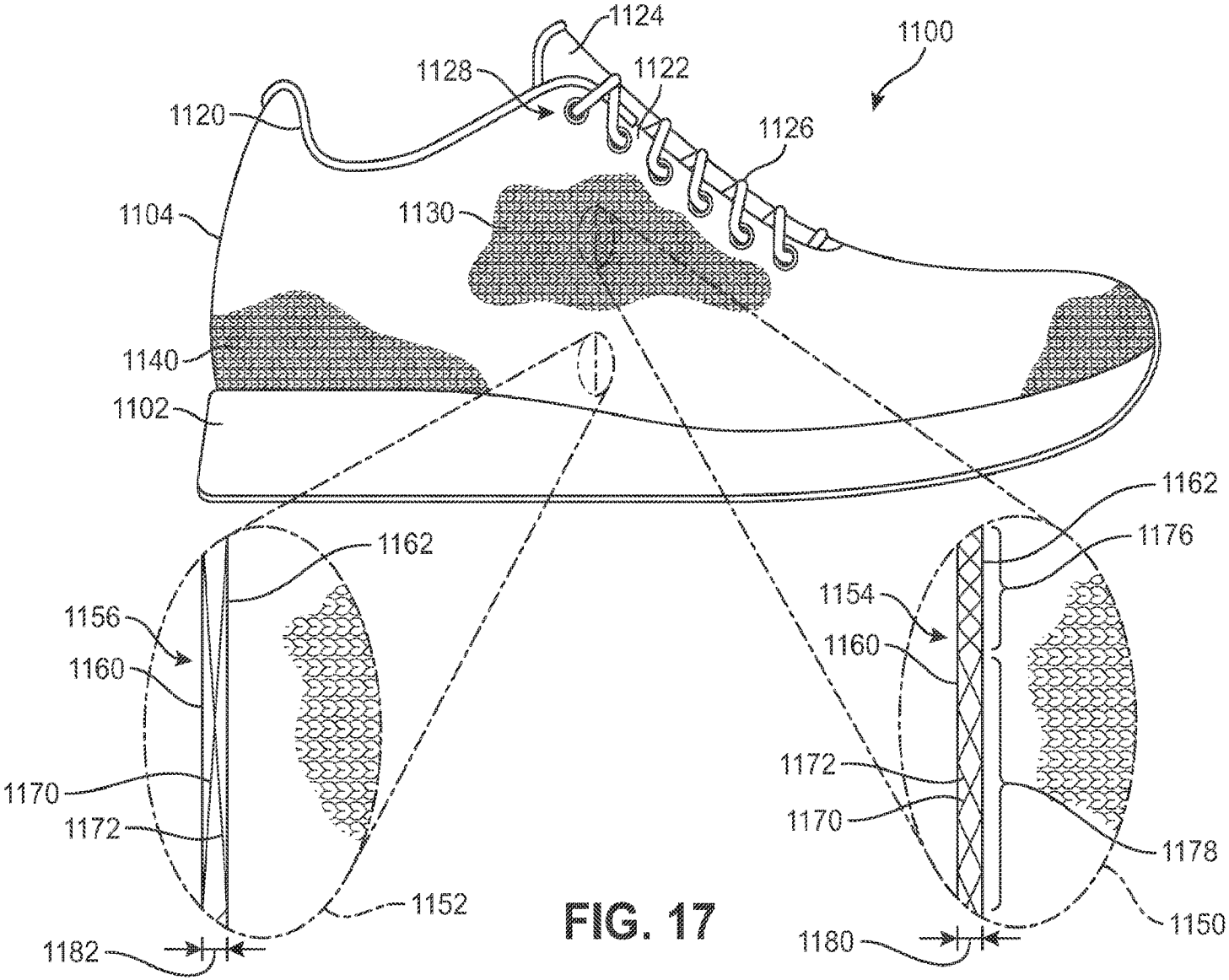
FIG. 17 is a schematic view of an alternate embodiment of an article of footwear incorporating multiple layers.

Referring to FIG. 17, an alternate embodiment of an article of footwear is depicted. Article 1100 includes upper 1104 and sole structure 1102. Additionally article 1100 includes collar 1120, tongue 1124 and instep area 1122. Further, article 1100 includes lace 1126 which may pass through lace apertures 1128. Upper 1104 may be formed from knitted component 1130. Knitted component 1130 may be formed in largely the same manner as knitted component 130 discussed previously. Further, article 1100 may include a stretch resistant area 1140. Stretch resistant area 1140 may resist stretch in an area that may be predefined prior to completion of article 1100. For example, the structure of stretch resistant area 1140 may be formed during a knitting process during the formation of upper 1104.

In some embodiments, article 1100 may be formed using multiple layers. In some embodiments, the multiple layers may include knit structures. As shown in FIG. 17, article 1100 includes two layers, interior layer 1160 and exterior layer 1162 including knit structures.

In some embodiments, article 1100 may incorporate cross-stitching. "Cross-stitching" as discussed in this Detailed Description relates to stitching extending between layers of fabric. In some embodiments, cross-stitching may be utilized such that a first layer of fabric and a second layer of fabric are spaced from one another. That is, in some embodiments, the thread used to form the cross-stitch may form a filler or spacer material between layers of fabric. In some embodiments, a specific type of cross-stitching may be used. For example, in some embodiments, a cross tuck may be utilized. A cross tuck is a tuck loop that extends from one knit layer to a second knit layer. The knit layers are connected by alternating tuck loops.

In some embodiments, multiple strands may be cross tucked between different layers. In other embodiments, a single strand may be cross tucked between different layers. As shown in FIG. 17, tensile strand 1170 and tensile strand 1172 may be utilized to cross tuck between interior layer 1160 and exterior layer 1162. Although tensile strand 1170 and tensile strand 1172 are shown as two separate strands, it should be recognized that in some embodiments, tensile strand 1170 and tensile strand 1172 may be formed from a single strand.

In some embodiments, each of tensile strand 1170 and tensile strand 1172 may form loops between interior layer 1160 and exterior layer 1162. In some embodiments, tensile strand 1170 and tensile strand 1172 may cross one another, depicted as an "X" shape in FIG. 17. In other embodiments, a single tensile strand may be utilized to connect interior layer 1160 and exterior layer 1162.

In some embodiments, cross stitching may affect the thickness of knitted component 1130. In some embodiments, thicker areas of knitted component 1130 may be located in areas of article 1100 where additional padding or cushioning may be desired. For example, in some embodiments, knitted component 1130 may be thicker in an area of upper 1104 that may rub against the ankle or top portion of a wearer. Thinner areas of upper 1104 may be located in areas where padding may not be necessary. For example, in some embodiments, thinner areas may be located adjacent to sole structure 1102. In some embodiments, a thinner area may assist in securing upper 1104 to sole structure 1102. In other embodiments, thicker and thinner areas may be arranged throughout article 1100 to allow for increased comfort in cushioning or for various design purposes.

In some embodiments, the number of loops in a cross stitching area may affect the thickness of knitted component 1130. Referring to enlarged portion 1150, cross tuck area 1154 incorporates multiple tuck loops as compared to cross tuck area 1156 of enlarged portion 1156. Therefore, thickness 1180 depicted in enlarged portion 1150 may be larger than thickness 1182 of enlarged portion 1152. By varying the number of loops in a cross tuck area, the thickness of the knitted component may be varied.

In some embodiments, the elasticity of an article may be varied by incorporating a different number of loops within the cross stitching area. By varying the number of loops between interior layer 1160 and exterior layer 1162 the stretchability or elasticity of upper 1104 may be altered. An area of article 1100 that incorporates fewer loops within the cross stitching area may be more stretch resistant than an area of article 1100 that incorporates more loops. For example, referring to enlarged portion 1150, cross tuck area 1154 includes multiple tuck loops. By contrast, cross tuck area 1156 includes fewer tuck loops. As shown in FIGS. 7-10 and discussed in the Detailed Description, incorporating fewer loops reduces the distance in which a strand may extend. Further, by incorporating tuck loops rather than jersey loops, the distance that a strand may extend may be further limited compared to a cross stitch area incorporating a jersey loop.

Various configurations of cross-stitching may be utilized. For example, in some embodiments, a tuck loop may be utilized. In other embodiments, a jersey loop may be utilized. As depicted, various tuck loops are used to connect an interior layer 1160 to an exterior layer 1162 of upper 1104.

In some embodiments, the spacing of cross tucks may be varied within a cross tuck area. In some embodiments, the number of cross tucks may increase or decrease along knitted component 1130. Referring to enlarged portion 1150, cross tuck area 1154 includes first portion 1176 and second portion 1178. As depicted, first portion 1176 includes a greater number of cross tucks than does second portion 1178. In this configuration, the thickness of first portion 1176 may be greater than the thickness of second portion 1178. Further, the cross tucks of second portion 1178 are more spaced than the cross tucks of first portion 1176. The spacing of the cross tucks of second portion 1178 may assist in reducing the thickness of second portion 1178. Additionally, second portion 1178 may be more stretch resistant than first portion 1176. Further, enlarged portion 1152 incorporates even fewer cross tucks than does first portion 1176 or first portion 1178. Therefore the thickness of enlarged portion 1151 may be less than second portion 1178. Further, enlarged portion 1152 may be more stretch resistant than first portion 1176 and second portion 1178. As such, the thickness and stretch resistance of an area of knitted component 1130 may be varied along a length or distance of upper 1104.

In some embodiments, the level of stretch resistance in an article may be varied to accommodate different levels of force that an article may experience during use. In some embodiments, the stretch resistant of an article may be varied such that the transition from stretch resistant to relatively elastic may be a seamless or unnoticeable transition to a wearer. In some embodiments, continuously varying the stretch resistance throughout an article may increase comfort to a user.

Figure 18:
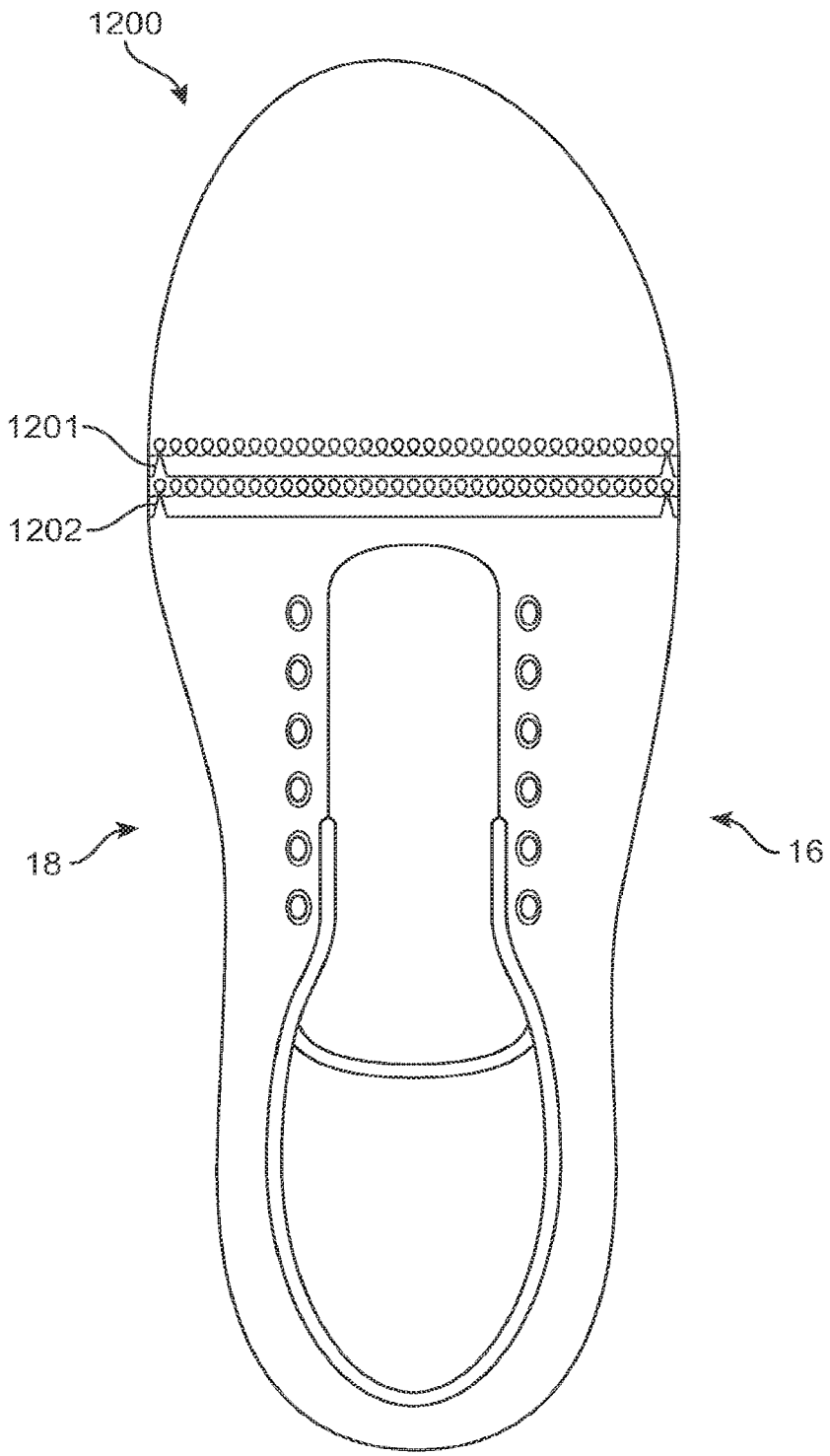
FIG. 18 is a top view of an embodiment of an article of footwear incorporating a large floated portion.

Referring to FIGS. 18-22 an article is depicted under normal use. Referring to FIG. 18, the top view of an article of footwear incorporating large floated portions is depicted from a top view. In this depiction, article 1200 includes a knitted component having technical tensile course 1201 and technical tensile course 1202. As depicted, the floated portions of technical tensile course 1201 and technical tensile course 1202 extend from medial side 18 to lateral side 16 of the upper. As such, technical tensile course 1201 and technical tensile course 1202 are configured to resist stretch laterally along article 1100.

Figure 19:
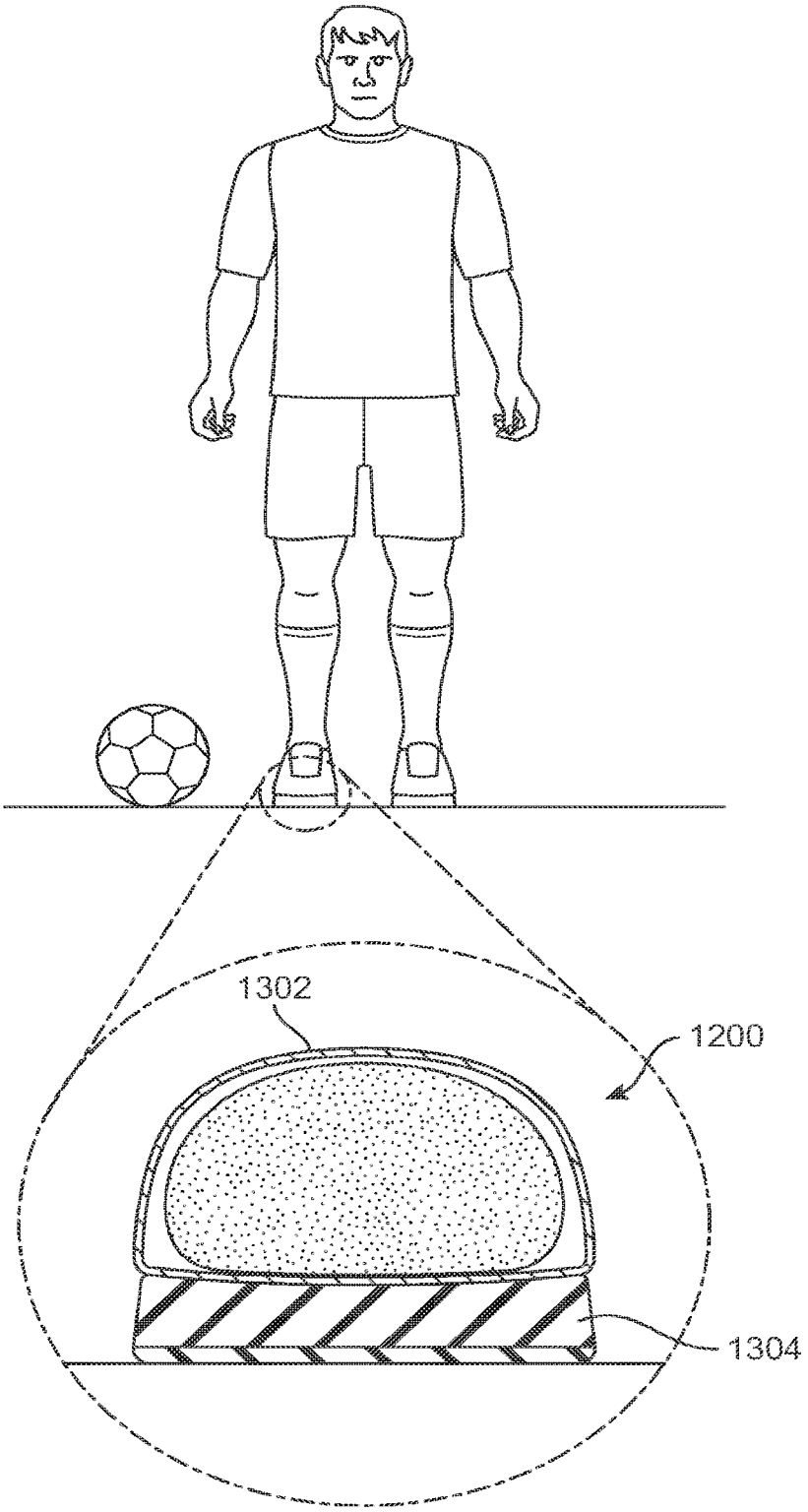
FIG. 19 is a representational view of an athlete standing with an enlarged cross-sectional view of a forefoot portion of an embodiment of an article.
Figure 20:
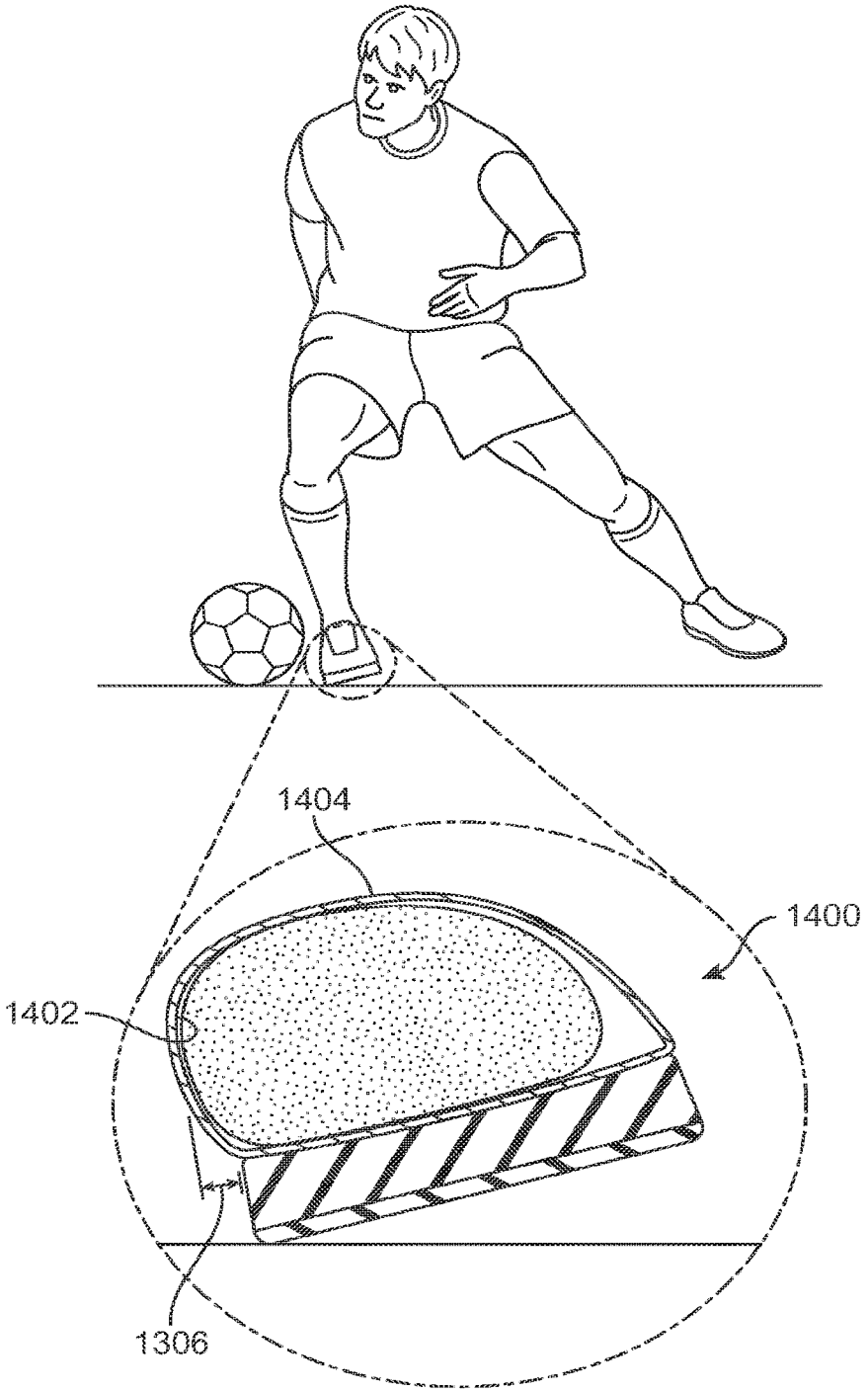
FIG. 20 depicts an athlete making a lateral maneuver with an enlarged cross-regional view of a forefoot portion of an embodiment of an article of footwear.
Figure 21:
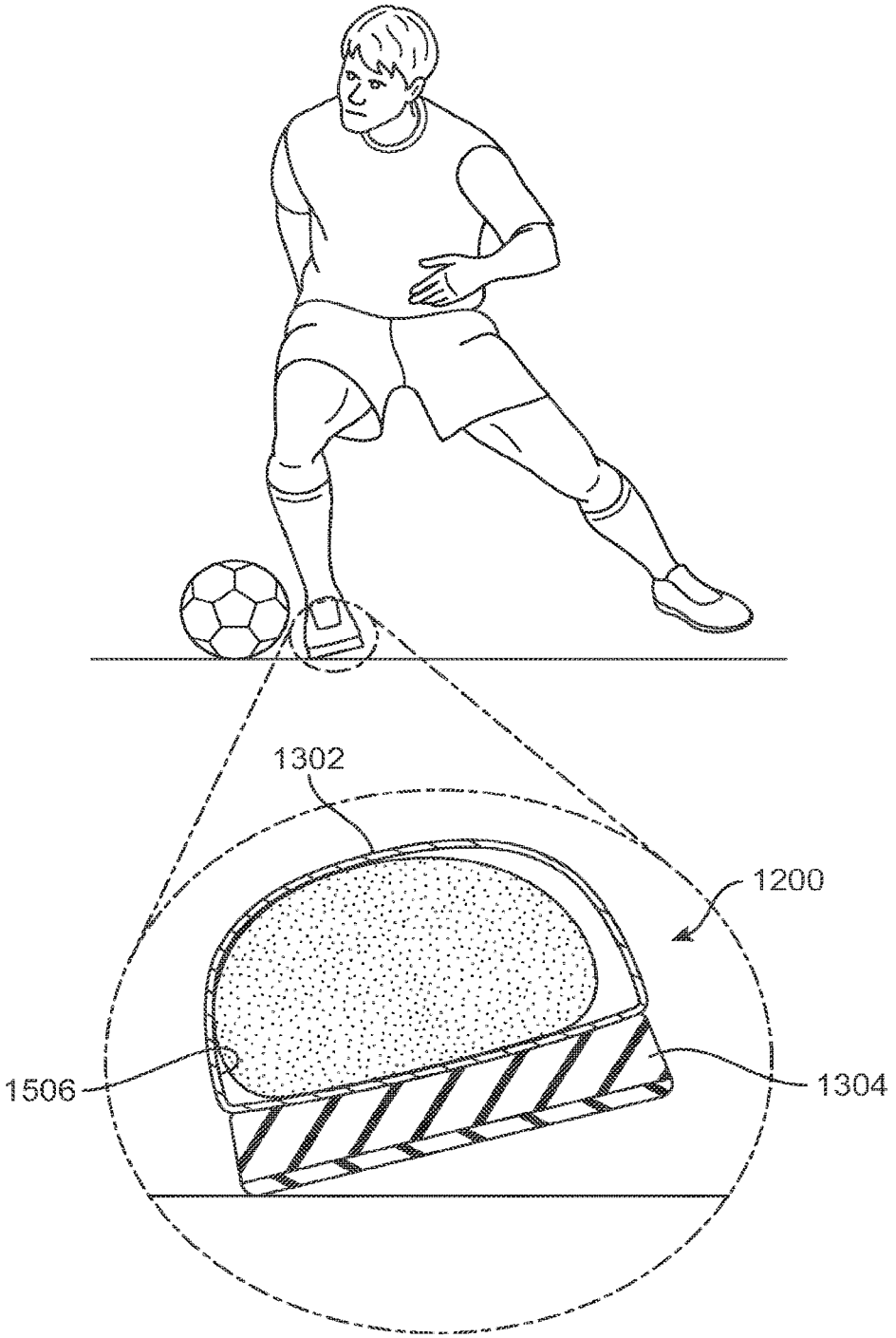
FIG. 21 is a representational view of an athlete making a lateral maneuver with an enlarged cross-regional view of a forefoot portion of an embodiment of an article of footwear that incorporates tuck stitches and large floated portions.

Referring to FIGS. 18-23, representative views of an article of footwear including an upper and a sole structure in use are depicted. FIG. 19 depicts an athlete wearing an article 1200. As shown in FIGS. 19-21, a cutaway of the forefoot portion of the article of footwear includes the forefoot portion of the foot of an athlete. Referring to FIG. 19, the foot of an athlete may comfortable be located within article 1200. FIG. 19 illustrates the athlete in a relaxed or non-moving state. While article 1200 may experience force on the sole structure 1304 in this state, minimal force may be exerted to portions of upper 1302 of article 1200.

Referring to FIGS. 20 and 21, the athlete is shown performing a sport or athletic activity. In this embodiment, an athlete is shown performing a typical motion for soccer, in particular, making a cutting motion. During such a cutting motion, lateral force may be exerted along portions of the upper of an article of footwear. As depicted in FIG. 20, article of footwear 1400 includes an upper 1404 that does not include provisions for distributing or reducing forces from a sport or athletic activity. In this embodiment, upper 1404 of article of footwear 1400 may incorporate a knitted component that does not include large floated portions selectively located to correspond with areas of an article that may be subjected to typical forces with the athletic activities of the athlete wearing article of footwear 1200.

FIG. 20 shows a cutaway view of article of footwear 1400 when subjected to a cutting motion by an athlete. As an athlete cuts laterally, forces exerted by the foot of an athlete press against interior surface 1402 of upper 1404. As depicted, upper 1404 may deform by a distance 1406 due to the force exerted on upper 1404 by the foot of an athlete. In some cases, this configuration may cause less stability and traction between article 1400 and the ground. Further, an athlete may have less control due to the deformation of article 1400.

FIG. 21 shows an exemplary embodiment of article of footwear 1200. As previously discussed, article 1200 includes a knitted component with large floated portions which may distribute forces through upper 1302. Additionally, the large floated portions may direct or distribute forces such that the stretch of upper 1302 may be limited in areas incorporating this structure. As depicted, article of footwear 1200 may form a less elastic structure than article 1400. The foot, in this case, may press against interior surface 1506. In this case, however, upper 1302 may better hold its shape than upper 1404 when subjected to a similar force. The floated portions may limit the stretch of upper 1302 and create channels or paths for the force to run along. The floated portions therefore may accept or direct the forces, thereby reducing the amount of force that may act upon other courses of the knitted component of upper 1302. The use of large floated portions may allow for better stability and control in areas of upper 1302 of article 1200 than in article 1400.

Figure 22:
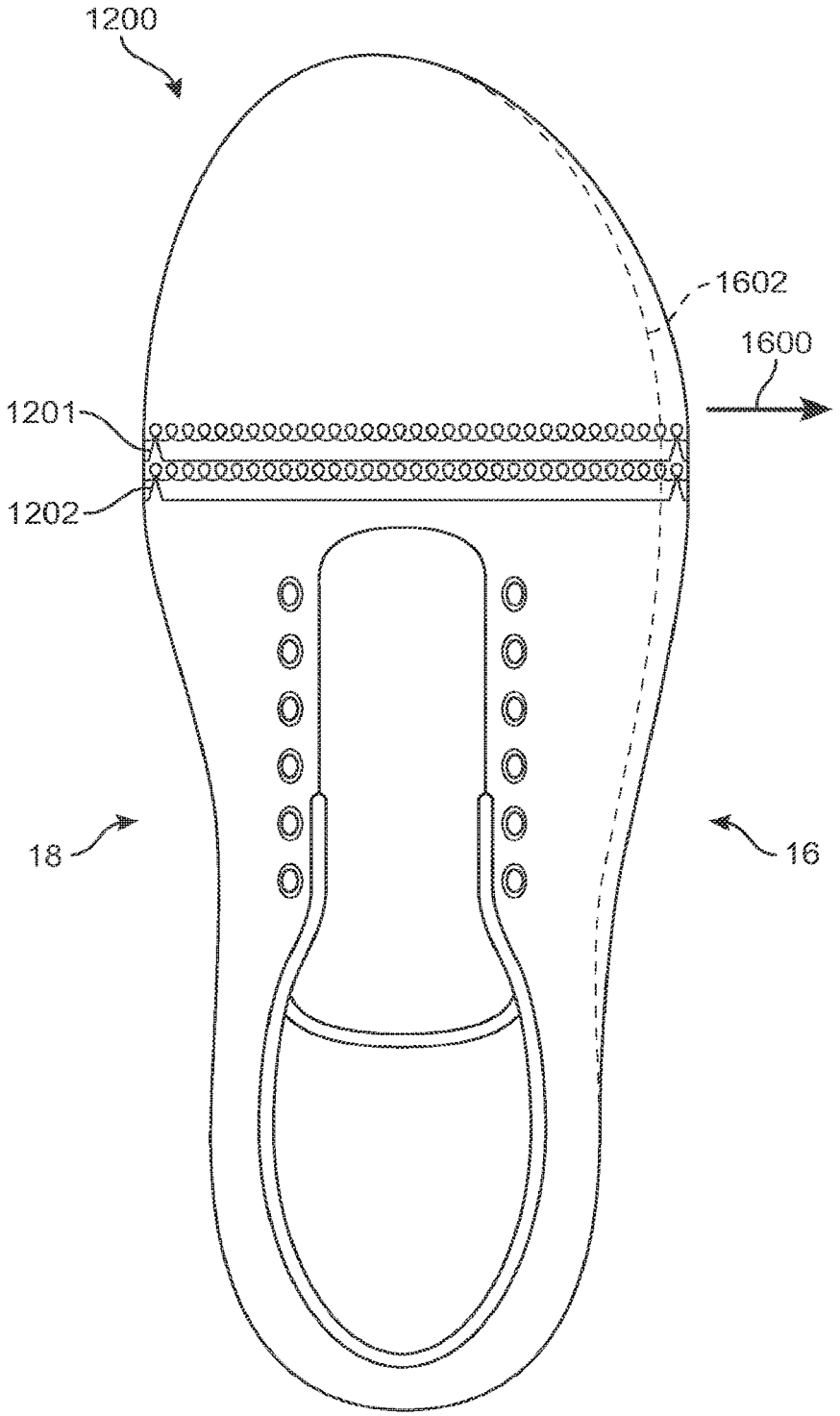
FIG. 22 illustrates a force acting on an embodiment of a knitted component that incorporates tuck stitches and large floated portions.
Figure 23:
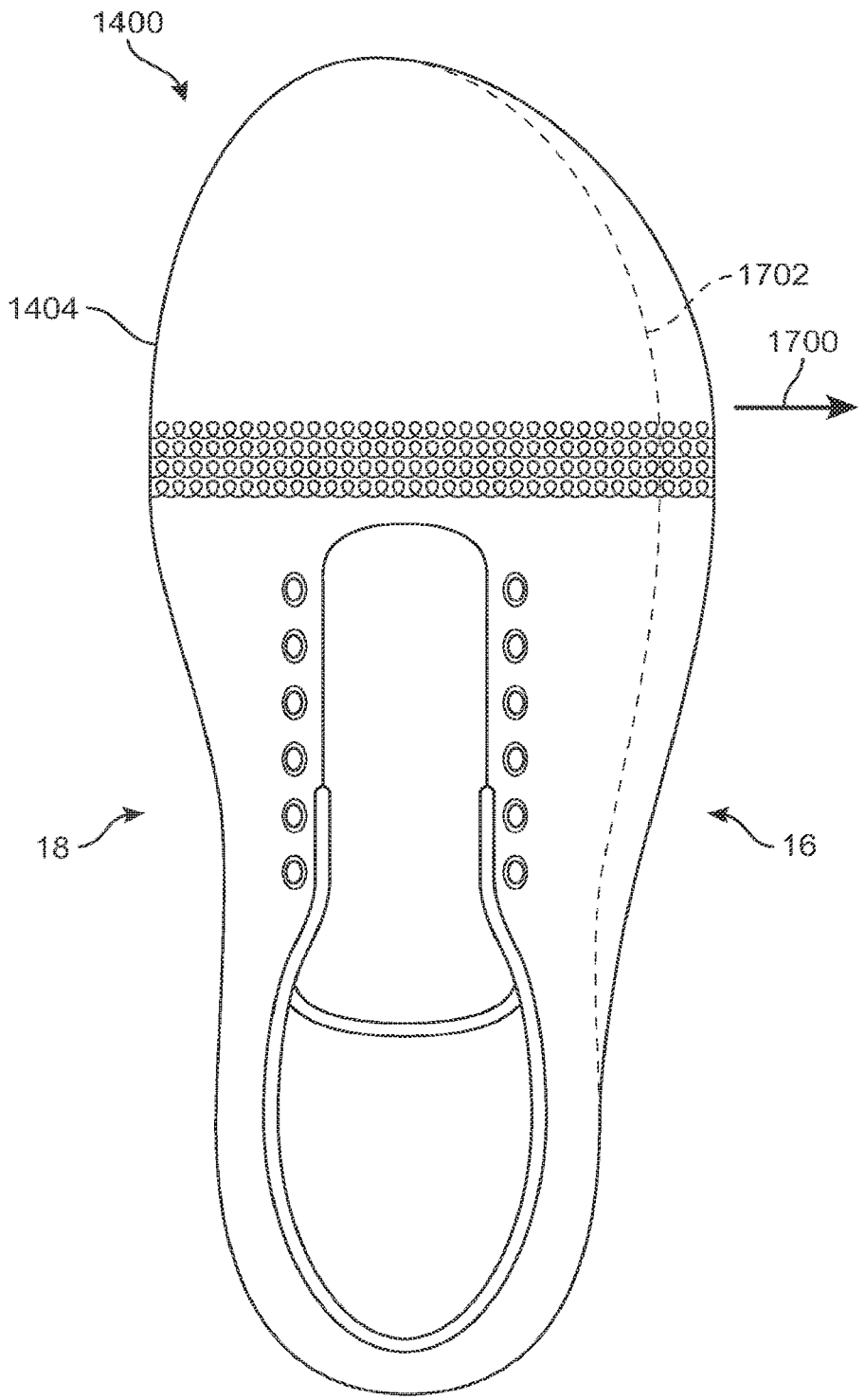
FIG. 23 illustrates a force acting on an embodiment of a knitted component that does not include tuck stitches and large floated portions.

FIGS. 22 and 23 illustrate a representative view of how forces may act upon courses within a knitted component. Article 1200 as depicted in FIG. 22 includes an upper incorporating a knitted component having multiple tensile courses that incorporate large floated portions. A force 1600 may be exerted laterally along the courses in the knitted component in areas of upper 1302 of article 1200. As force 1600 acts upon the knitted component in areas of upper 1302 article 1200, upper 1302 of article 1200 may deform a small amount. Force 1600 may cause the tuck stitches of technical tensile course 1201 and technical tensile course 1202 in the knitted component incorporated into upper 1302 to flatten and lengthen technical tensile course 1201 and technical tensile course 1202 as depicted in FIGS. 13 and 14. This action may lead to a slight deformation of the knitted component of upper 1302 of article 1200. As shown, the steady state formation of article 1200 depicted as a dotted line 1602, may be altered to the solid line of article 1200.

FIG. 22 depicts article 1400 including an upper 1404 incorporating a knitted component that does not utilize tensile courses or large floated portions. Rather, the knitted component of article 1400 utilizes only courses formed of jersey loops. As depicted, a force 1700 is shown acting on the knitted component incorporated into upper 1404 in a lateral direction. Because the knitted component incorporated into upper 1404 does not incorporate tensile courses including large floated portions, the knitted component of upper 1404 may deform or stretch laterally. In comparison to article 1200 depicted in FIG. 22, article 1400 may stretch to a greater degree. As depicted, upper 1404 of article 1400 may extend from a steady state as depicted by dotted line 1702 to the solid line of article 1400. The loops of each course in the knitted component incorporated into upper 1404 may extend or flatten as depicted in FIGS. 15 and 16 and therefore the size and shape of the knitted component incorporated into upper 1404 may deform accordingly.

The configuration of upper 1302 may result in reduced distortion or alteration of shape as compared to upper 1404. The knitted component in areas of upper 1302 of article 1200 includes large floated portions particularly located to distribute forces that may act upon upper 1302. The use of large floated portions in the knitted component in areas of upper 1302 of article 1200 may increase performance and durability, as well as increase a user's comfort and feel as compared to upper 1404.

Figure 24:
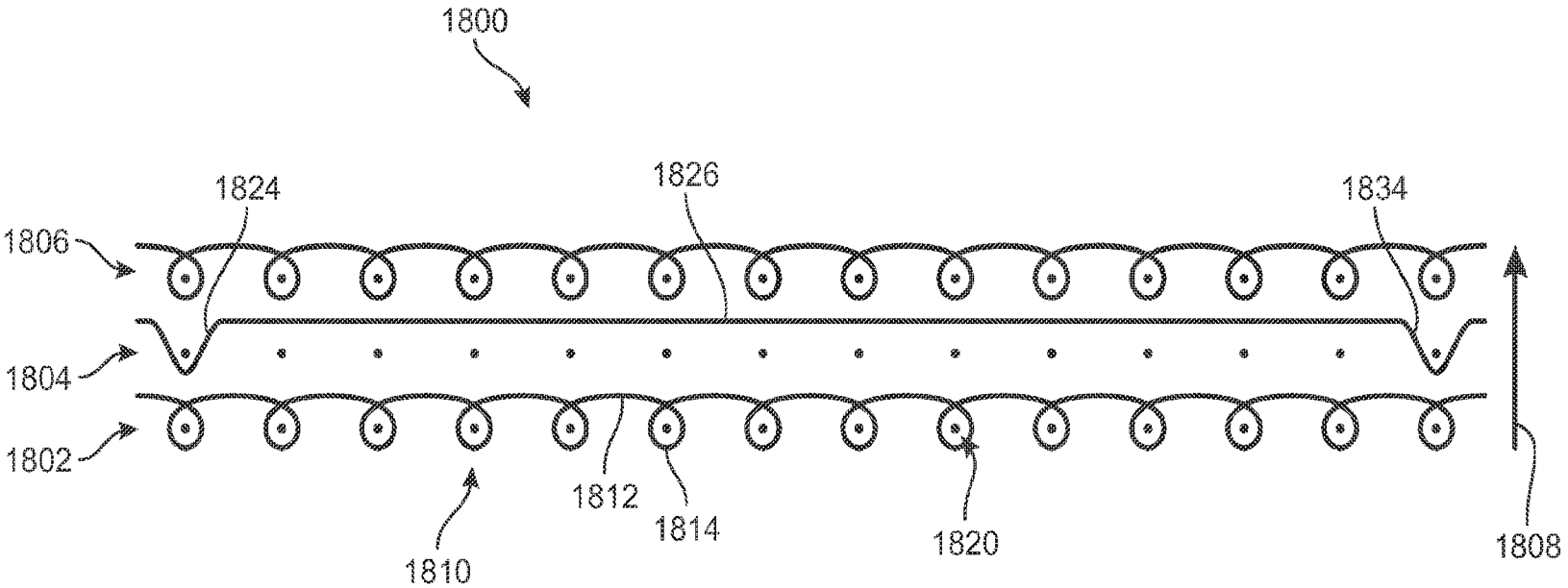
FIG. 24 depicts an exemplary looping diagram incorporating tuck stitches and a floated portion.

Referring to FIG. 24, a looping diagram of a portion of a knitted component is depicted. Looping diagram 1800 depicts three courses that may be used in the formation of a knitted component. As depicted, looping diagram 1800 includes technical course 1802, technical tensile course 1804 and technical course 1806. Arrow 1808 indicates the knitting direction. That is, as shown, first technical course 1802 is formed. Technical tensile course 1804 is formed second and interacts with technical course 1802. Technical course 1806 is the final course formed. Technical course 1802 includes a plurality of jersey loops 1810. Each of jersey loops 1810 interacts with needles 1820, depicted in loop diagram 1800 as dots. As shown, every needle along technical course 1802 interacts with technical course 1802. In other embodiments, some of needles 1820 may not interact with technical course 1802. Many different configurations of needles and loops may be used to form technical course 1802.

As shown in looping diagram 1800, jersey loops 1810 are formed on the front needle bed of a knitting machine. The orientation of jersey loops 1810 indicates that they are formed on the front needle bed. Locating the floated portion 1812 toward the top of the diagram and the head portion 1814 toward the bottom of the page indicates that technical course 1802 is formed on the front bed of a knitting machine. Additionally, technical tensile course 1804 and technical course 1806 are formed on the front needle bed.

Referring to technical tensile course 1804, the looping diagram notation for technical tensile course 1804 includes a tuck stitch 1824. The symbol used to depict a tuck stitch is generally a partial triangle. A large floated portion 1826 extends between tuck stitch 1824 and tuck stitch 1834. As depicted, technical tensile course 1804 does not interact with most of needles 1820. Rather, floated portion 1826 passes along twelve of needles 1820 without interlooping with needles 1820.

Looping diagrams similar to looping diagram 1800 may be utilized in forming a knitted component. Looping diagrams may serve as a consistent representation of how a knitted component may be formed. Additionally, different variations of looping diagrams may be utilized throughout this Detailed Description.

Knitting Machine Configuration

Figure 25:
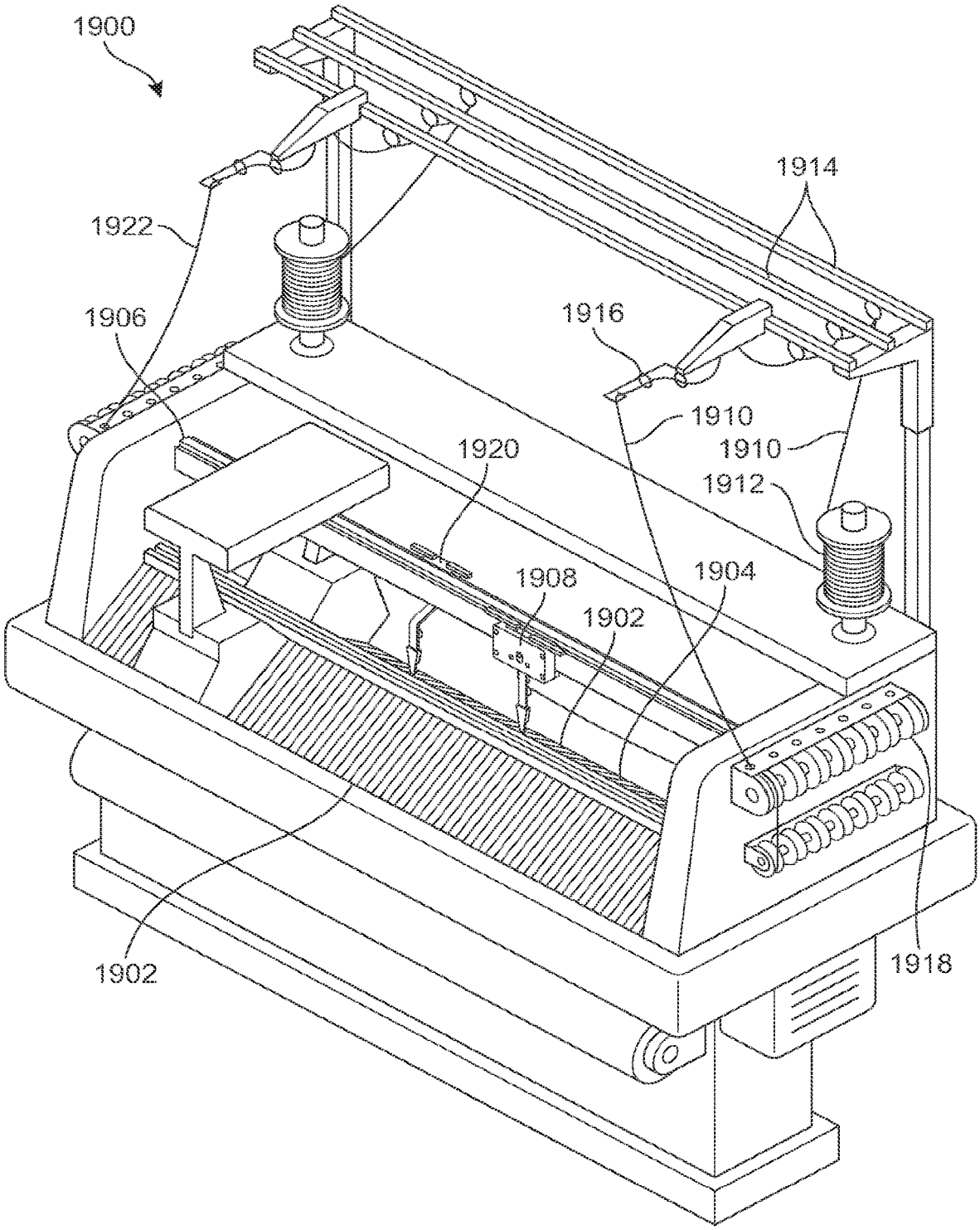
FIG. 25 is a perspective view of an embodiment of a knitting machine.

Although knitting may be performed by hand, commercial manufacturing of knitted components is generally performed by knitting machines. An example of a knitting machine capable of producing a knitted component, including any of the embodiments of knitted components described herein, is depicted in FIG. 25. Knitting machine 1900 is configured as a v-bed flat knitting machine; however, other types of knitting machines may be suitable for construction of the knitted component. For example, a flatbed flat knitting machine may also be utilized in some instances.

In some embodiments, knitting machine 1900 may include two needle beds 1902. In some cases, needle beds 1902 may be angled thereby forming a v-bed. Each needle bed 1902 contains a plurality of individual needles 1904 that lay on a common plane. That is, needles 1904 of one needle bed 1902 lie in one plane while needles 1904 of the other needle bed 1802 lie in a different plane. The first plane and second plane are angled such that the intersection of the planes extends along a majority of the width of the knitting machine 1900. As described in further detail below, needles 1904 may have a first position where they are retracted, a second position where they are extended, and a third position where they are partially extended. In the first position the needles are spaced from the intersection point. In the second position the needles may pass through the intersection point. In the third position the needles are located between the first position and the second position.

A rail 1906 extends above and parallel to the intersection of needle beds 1902. The rail may provide attachment points for feeder 1908. The feeder 1908 may supply yarn 1910 to needles 1904 in order for the needles 1904 to manipulate yarn 1910. In addition, another feeder 1920 may supply a second yarn 1922 to needles 1904 in order for needles 1904 to manipulate yarn 1922. Due to the action of a carriage, feeder 1908 may move along the rail 1906 and needle bed 1902, thereby supplying yarn 1910 to needles 1904. Additionally, feeder 1920 may move along rail 1906 and needle bed 1902, thereby supplying yarn 1922 to needles 1904. In FIG. 25, a yarn 1910 is provided to feeder 1908 by a spool 1912. More particularly, yarn 1910 extends from spool 1912 to various yarn guides 1914, a yarn take-back spring 1916 and a yarn tensioner 1918. The feeder 1908 has the ability to supply a yarn that needles 1904 may manipulate to knit, tuck and float. Some machines may have multiple spools take back springs, and tensioners such that feeder 1920 may receive yarn 1922 and feeder 1908 may receive yarn 1910. The multiple yarns may be utilized in the knit structure.

The manner in which knitting machine 1900 operates to manufacture a knitted component will now be discussed in detail. Moreover, the following discussion will demonstrate certain knit combinations as well as gore creation.

Figure 26:
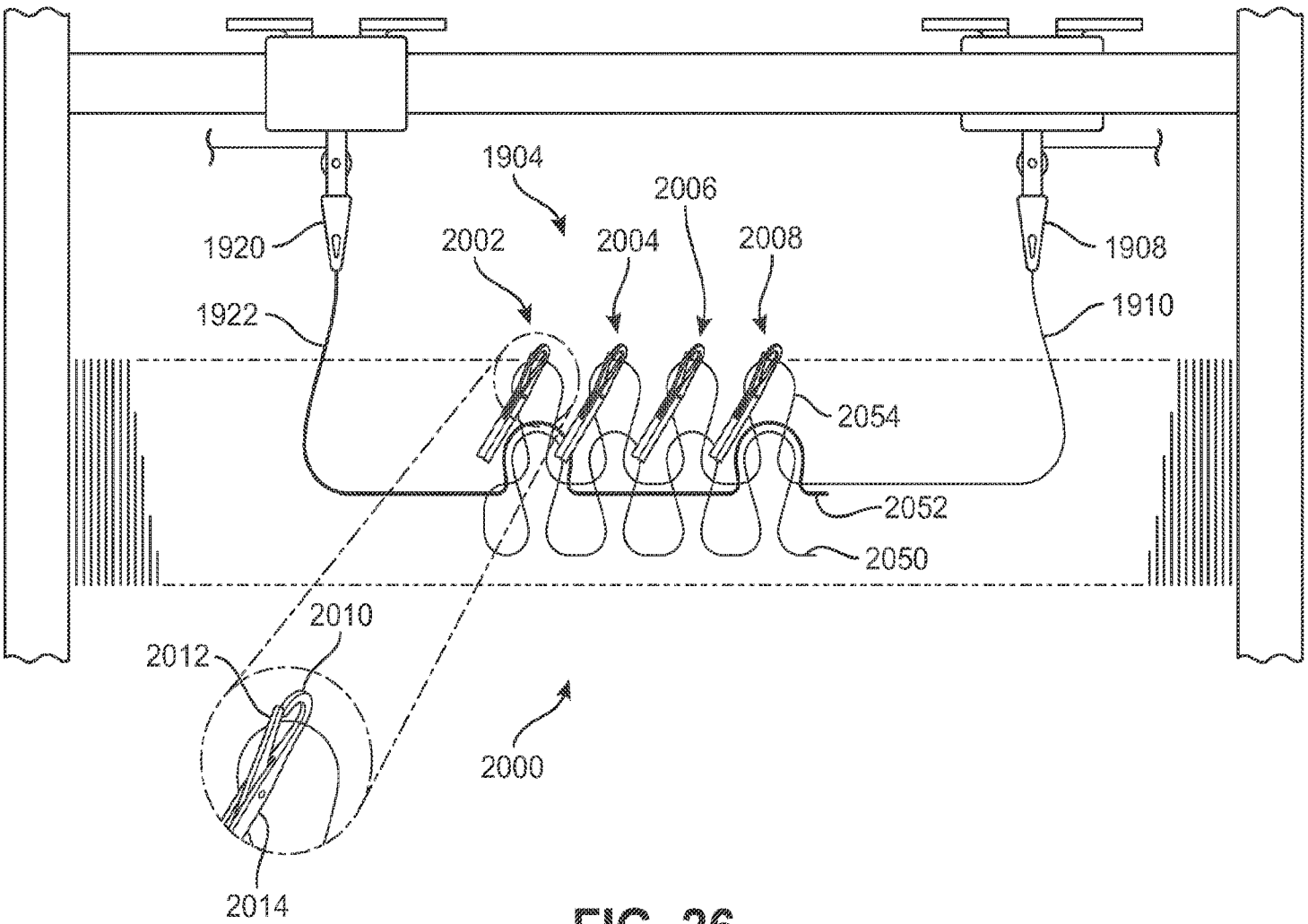
FIG. 26 is a schematic view of an exemplary embodiment of a knitted component during an aspect of the knitting process.

FIGS. 26 through 31 depict a knit element in the process of being manufactured. FIG. 26 depicts a portion of knit element 2000. Feeder 1908 passes yarn 1910 to accepting needles 1904 which may retract and extend to form knit element 2000. Additionally, feeder 1920 may pass yarn 1922 to needles 1904 which may retract and extend to form knit element 2000. Needles 1904 are shown in the retracted position. In this position needles 1904 accepted yarn 1910 and formed loops. For purposes of clarity, needles 1904 may include fewer needles than on a typical knitting machine 1900. Needles 1904 may include: needle 2002, needle 2004, needle 2006, and needle 2008.

Each of the individual needles within needles 1904 may include a hook portion 2010, arm 2012, and stem 2014. Yarn 1910 and yarn 1922 may pass into hook portion 2010 when arm 2012 is in an open position. Arm 2012 may be considered in an open position when arm 2012 is pivoted away from hook portion 2010. After a loop is formed using needles 1904, the loop may be passed out of hook portion 2010 and onto stem 2014. Needles 1904 may move into an extended position. As needles 1904 move, yarn 1910 and yarn 1922 may press against arm 2012, moving arm 2012 from a closed position to an open position. The open position of arm 2012 allows the loop of yarn 1910 to travel out of hook portion 2010, over arm 2012 and onto stem 2014.

Additionally, in this configuration, knit element 2000 includes three technical courses. Knit element 2000 includes technical course 2050, technical tensile course 2052, and technical course 2054. In this configuration, technical course 2050 and technical course 2054 may be formed using yarn 1910. Technical tensile course 2052, by contrast, may be formed by using yarn 1922. As shown in FIG. 26, technical tensile course 2052 and technical course 2050 may be layered or plaited or otherwise combined such that technical tensile course 2052 and technical course 2050 form a single visual course. Looping diagram 2100 of FIG. 27 depicts the looping diagram in order to show the structure of knit element 2000 as depicted in FIG. 26 in an alternate display.

Figure 27:
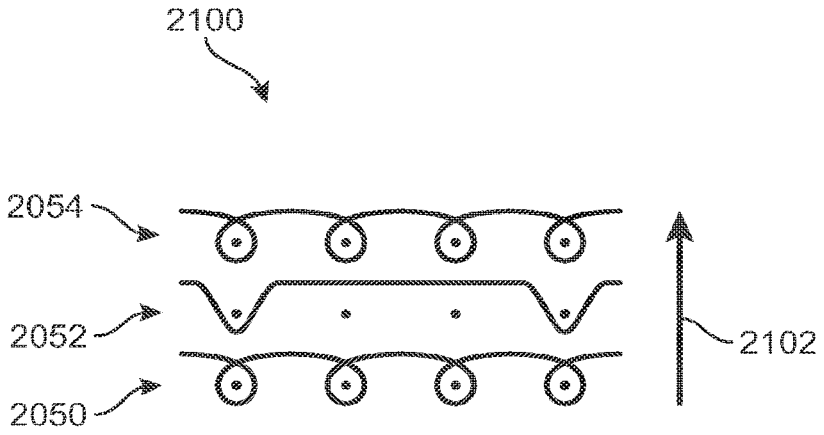
FIG. 27 is looping diagram of the knitted component depicted in FIG. 26.

Referring to FIG. 27, the knit element of FIG. 26 is depicted in a looping diagram. Arrow 2102 indicates the knitting direction. For example, technical course 2050 may be knit first. Technical tensile course 2052 may be knit second and interact with technical course 2050. Technical course 2054 may be knit last in this configuration.

Figure 28:
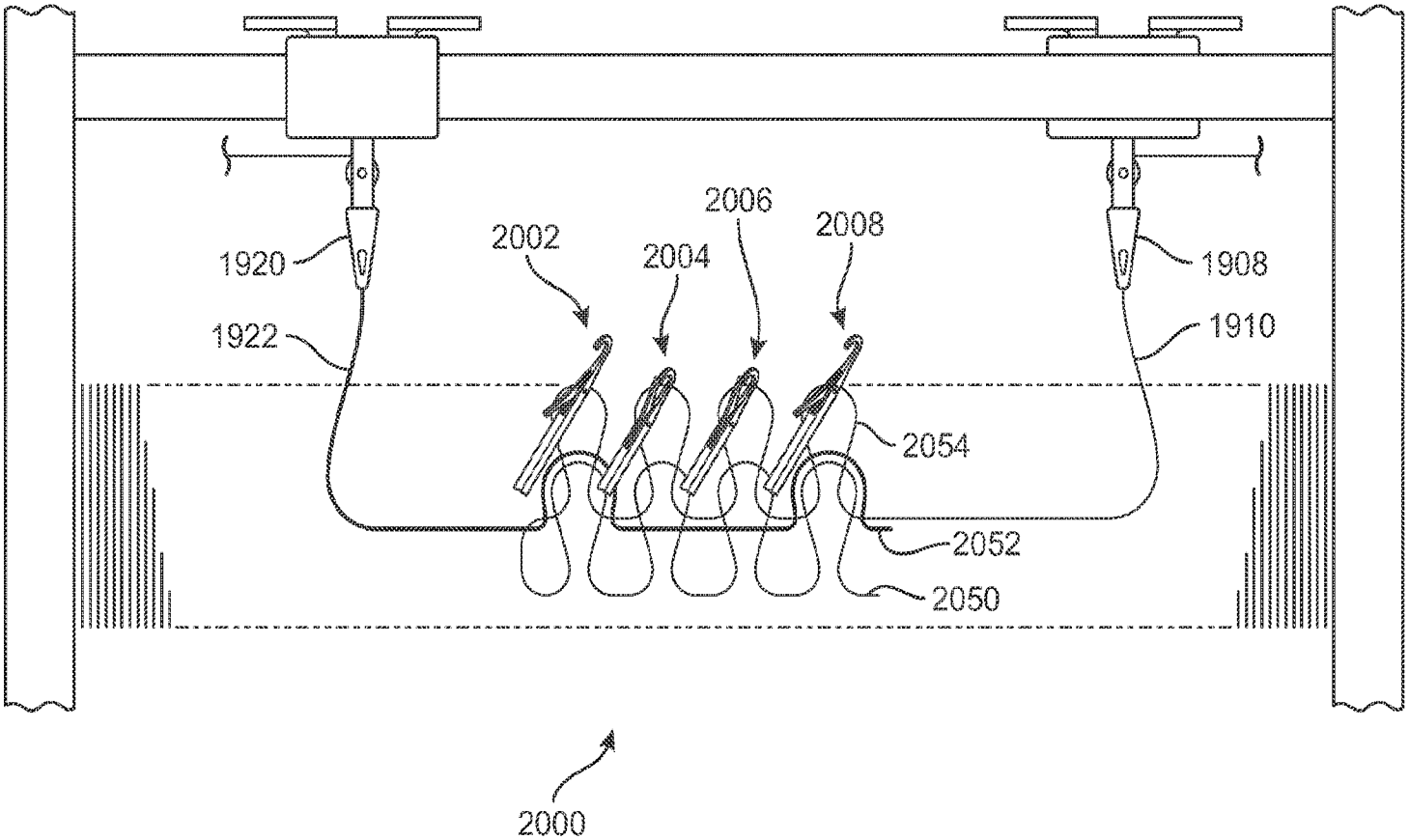
FIG. 28 is a schematic view of an exemplary embodiment of a knitted component during another aspect of the knitting process.

In FIG. 28, needle 2002 and needle 2008 partially extend while needle 2004 and needle 2006 remain in the retracted position. In the partially extended positions of needle 2008 and needle 2002, yarn 1908 is not passed off of needle 2008 and needle 2002. In this position, the loops on needle 2002 and needle 2002 move toward arm 2012; however the loops formed by yarn 1908 are not passed off onto stem 2014.

Figure 29:
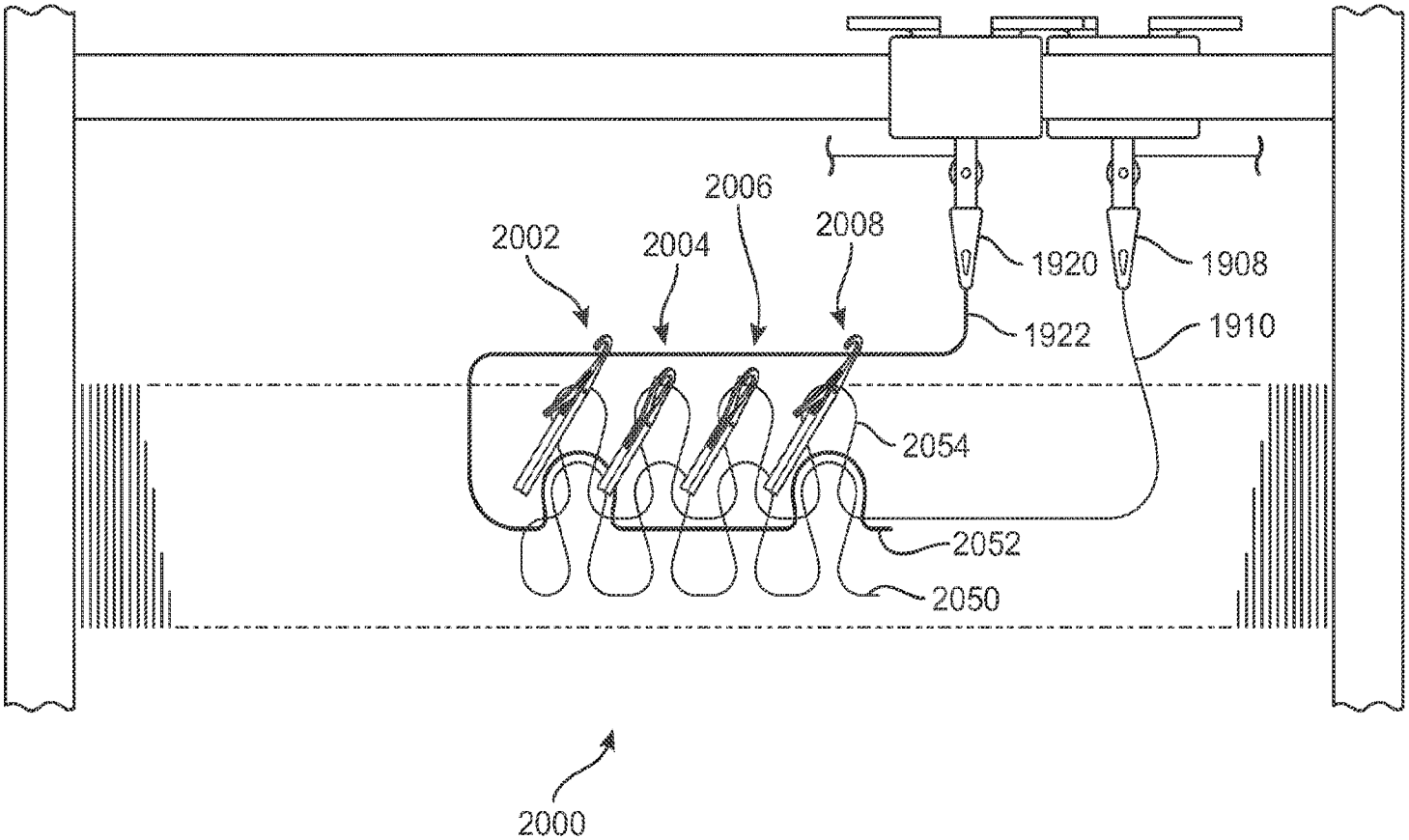
FIG. 29 is a schematic view of an exemplary process of a feeder passing yarn to the needles.

In FIG. 29, feeder 1920 passes over partially extend needle 2002 and partially extended needle 2008. Feeder 1920 deposits yarn 1922 into the hook portion of needle 2002 and needle 2008. In this configuration, needle 2002 and needle 2008 have not passed off loops formed by yarn 1910.

Figure 30:
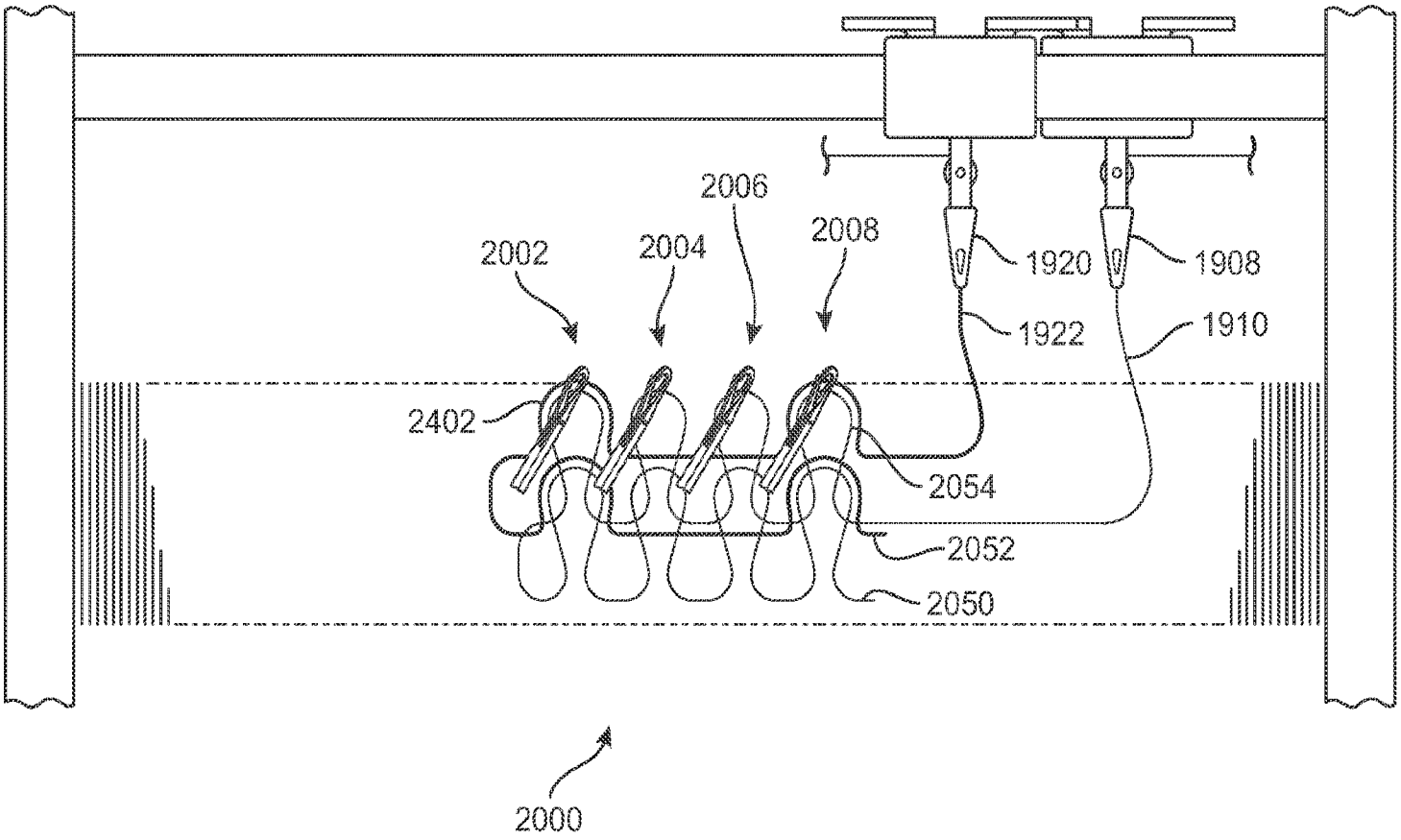
FIG. 30 is a schematic view of an exemplary process of needles intertwining the yarn with loops.

FIG. 30 shows all needles 1904 in a retracted position. From FIG. 28, needle 2002 and needle 2008 retract. In this depiction, a fourth technical course, technical tensile course 2402 has been formed.

Figure 31:
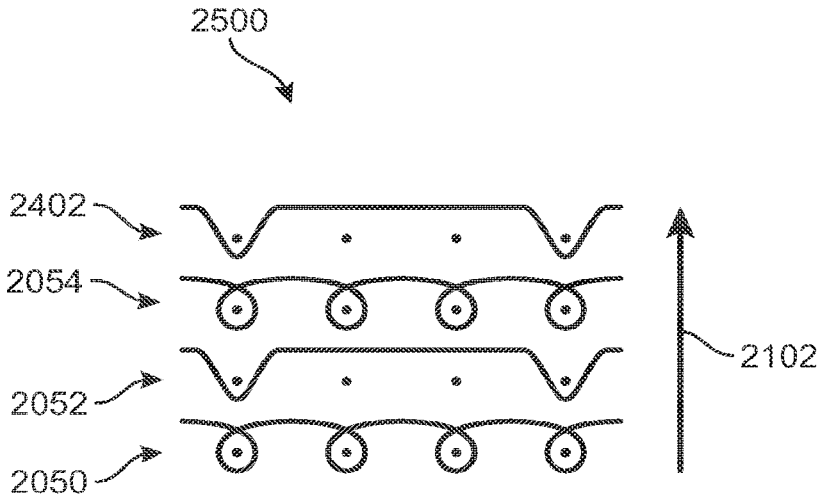
FIG. 31 is a looping diagram of the knitted component depicted in FIG. 30.

FIG. 31 depicts knit element 2000 of FIG. 30 in looping diagram 2500. As depicted, technical tensile course 2402 has been formed after technical course 2054. Although knit element 2000 includes four technical courses in this configuration, knit element 2000 may include two visual courses. Technical course 2050 and technical tensile course 2052 may interact as shown in FIG. 30 to appear as a single course. Likewise, technical course 2054 and technical tensile course 2402 make interact and interloop to appear as a single visual course. In this configuration therefore, knit element 2000 may appear to include two visual courses. By varying the loops of each course, different visual effects may be utilized.

Figure 32:
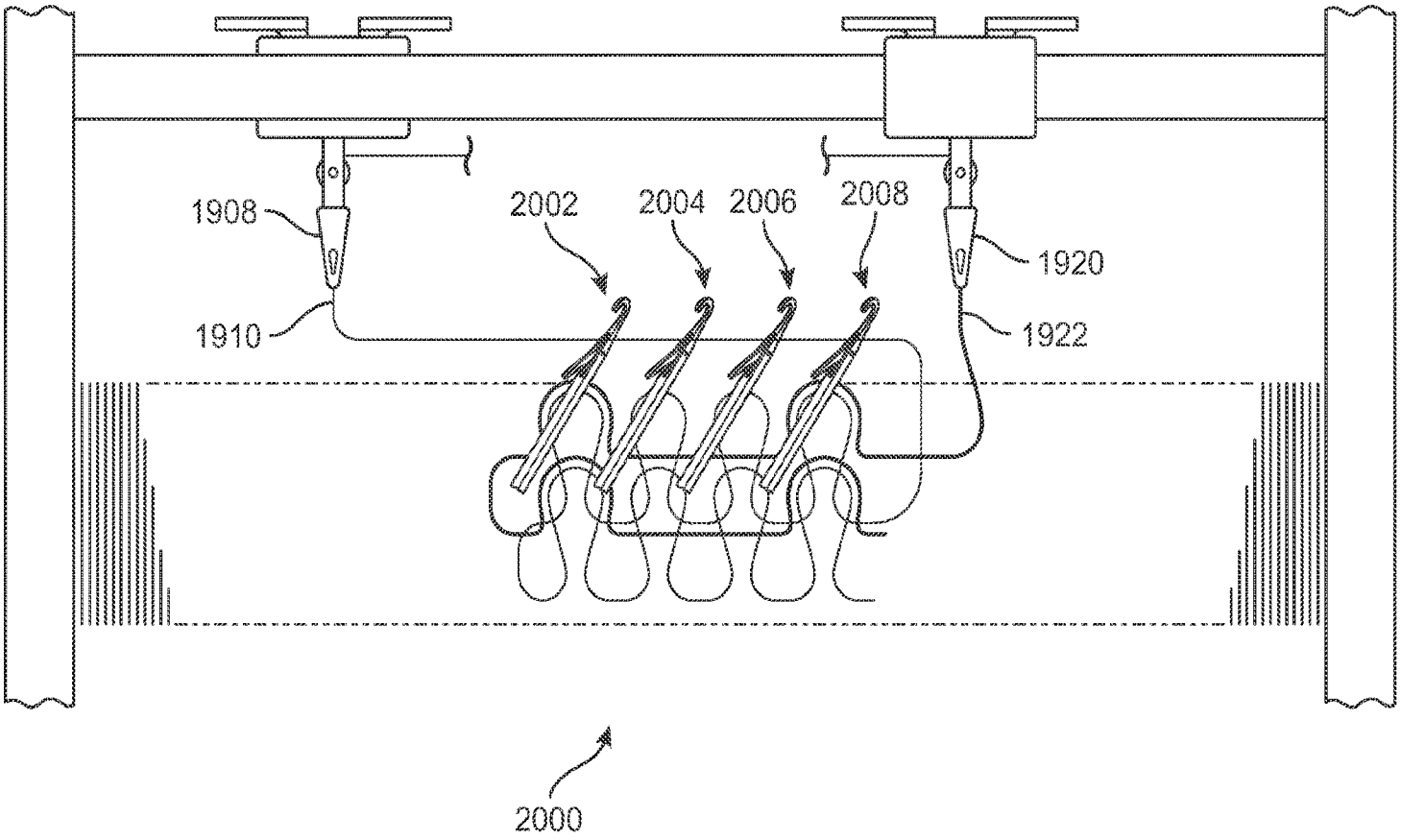
FIG. 32 is a schematic view of an exemplary process of a plurality of needles extending and accepting yarn from a feeder.

FIG. 32 depicts needles 2004 in an extended position in order to accept yarn 1910 from feeder 1908. Needle 2002 and needle 2008 pass of loops formed from yarn 1910 as well as loops formed from yarn 1922. Needle 2004 and needle 2006 pass of yarn 1910. Needle 2004 and needle 2006, however, had not previously extended to accept yarn 1922, and therefore do not pass off yarn 1922.

Figure 33:
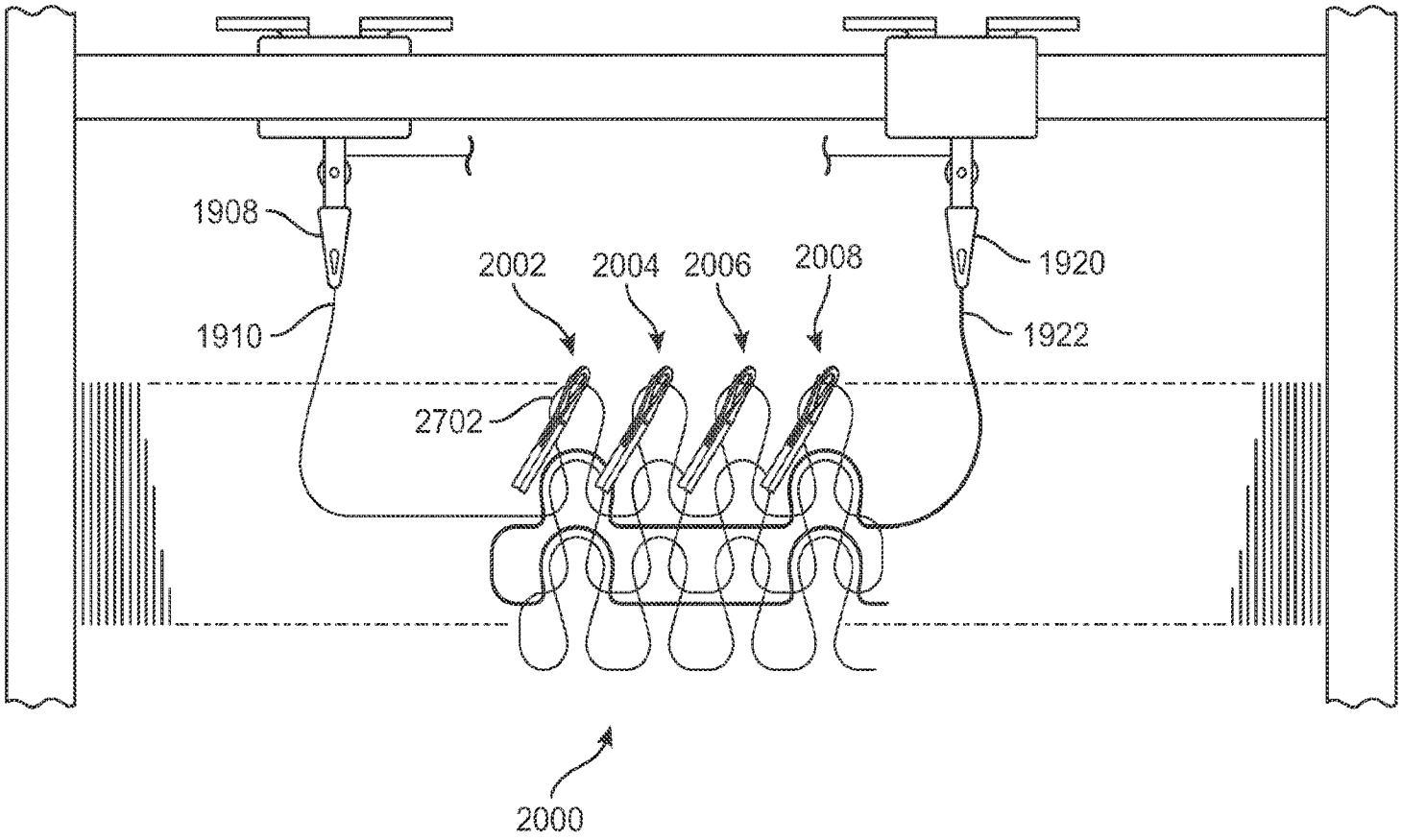
FIG. 33 is a schematic view of an exemplary process of needles retracting and intertwining the yarn with the previous intermeshed loops.

Referring to FIG. 33, needles 1904 retract and interact with yarn 1910 and form an additional course 2702. In this configuration, knit element 2000 now includes five technical courses, however, knit element 2000 may appear to include three visual courses. Technical course 2050 and technical tensile course 2052 may appear as a single visual course. Technical course 2054 and technical tensile course 2402 may appear as a single visual course. Additionally, technical course 2702 may appear as a single visual course.

Figure 34:
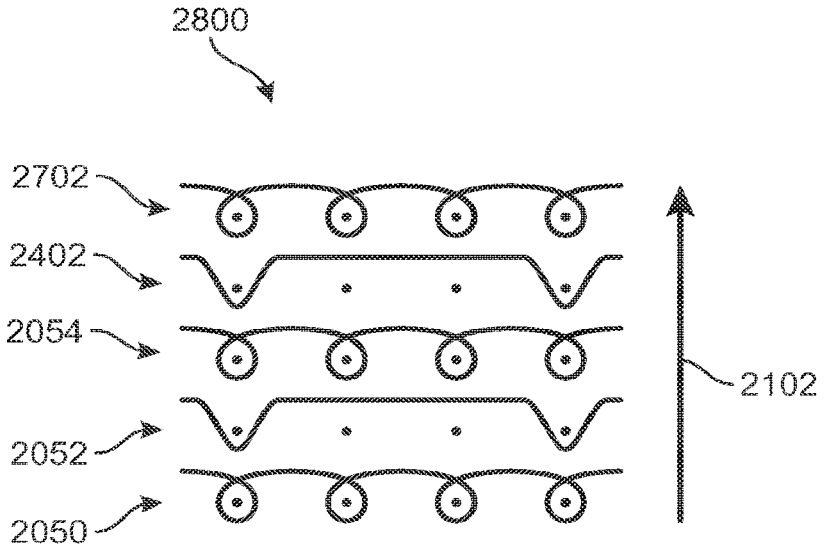
FIG. 34 is a looping diagram of the knitted component depicted in FIG. 33.

FIG. 34 includes looping diagram 2800 that depicts knit element 2000 of FIG. 33 in a looping diagram format. As depicted, technical course 2702 is formed after technical tensile course 2402. Technical course 2702 includes a loop at each needle location, in contrast to technical tensile course 2402 and technical tensile course 2052. Although the placement and layout of each of the courses in knit element 2000 are displayed as a pattern of tensile courses and other courses in similar configurations, it should be recognized that various configurations of courses and tensile courses may be utilized.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims. As used in the claims, any of when referencing the previous claims is intended to mean (i) any one claim, or (ii) any combination of two or more claims referenced.

I claim:

1. An upper for an article of footwear, comprising:

a knitted component including a first course, a second course, and a third course, each of the first course, the second course, and the third course extending from a perimeter edge at a lateral side of the upper to a perimeter edge at a medial side of the upper, wherein the first course and the third course each comprises a plurality of loops, wherein the second course is positioned between the first course and the third course and is interlooped with the first course and the third course, the second course comprising a first tuck stitch located adjacent the perimeter edge at the lateral side of the upper and a second tuck stitch located adjacent the perimeter edge at the medial side of the upper, and wherein the second course comprises a floated portion extending from the first tuck stitch to the second tuck stitch to form a stretch resistant area of the upper.

2. The upper of claim 1, wherein the first course includes a first yarn and the second course includes a second yarn, and wherein the first yarn has a higher elasticity than the second yarn.

3. The upper of claim 1, wherein the first course and the second course include separate yarns.

4. The upper of claim 1, wherein the floated portion of the second course extends a distance corresponding with a distance covering at least ten loops of at least the first course.

5. An article of footwear, comprising:

an upper comprising a knitted component including a first course, a second course, and a third course, each of the first course, the second course, and the third course extending from a perimeter edge at a lateral side of the upper to a perimeter edge at a medial side of the upper, wherein the first course and the third course each comprises a plurality of loops, wherein the second course is positioned between the first course and the third course and is interlooped with the first course and the third course, wherein a first tuck stitch of the second course is located adjacent to the perimeter edge at the lateral side of the upper, wherein a second tuck stitch of the second course is located adjacent to the perimeter edge at the medial side of the upper, and; wherein the second course comprises a floated portion extending from the first tuck stitch to the second tuck stitch to form a stretch resistant area of the upper; and a sole structure secured to the upper.

6. The upper of claim 5, wherein the knitted component includes a fourth course extending from the perimeter edge at the lateral side to an interior edge, the fourth course comprising a second floated portion, the second floated portion lacking knitted loops.

7. The upper of claim 5, wherein the floated portion extends a distance corresponding with a distance covering at least ten loops of an at least the first course.

8. The upper of claim 5, wherein the first tuck stitch is interlooped with a first loop of the third course, and wherein the second tuck stitch is interlooped with a second loop of the third course.

9. The upper of claim 8, wherein a yarn forming the second course includes less elasticity than a yarn forming the third course.

10. The upper of claim 5, wherein the first course and the second course include separate strands.

11. An upper for an article of footwear, comprising:

a knitted component including a first course, a second course, a third course, and a fourth course, each of the first course, the second course, and the third course extending from a perimeter edge at a lateral side of the upper to a perimeter edge at a medial side of the upper, wherein the second course is positioned between the first course and the third course and is interlooped with the first course and the third course, the second course comprising a first tuck stitch located adjacent the perimeter edge at the lateral side of the upper and a second tuck stitch located adjacent the perimeter edge at the medial side of the upper, and wherein the second course comprises a floated portion extending from the first tuck stitch to the second tuck stitch to form a stretch resistant area of the upper; and the fourth course comprising a second floated portion extending from a third tuck stitch adjacent the perimeter edge on a lateral side and a fourth tuck stitch in a throat area of the upper.

12. The upper of claim 1, wherein the knitted component includes a fourth course extending from the perimeter edge at the lateral side to an interior edge, the fourth course comprising a second floated portion.

13. The upper of claim 12, where the fourth course comprises a fourth tuck stitch adjacent the perimeter edge at the lateral side, the second floated portion extending between the third tuck stitch and the fourth tuck stitch.

* * * * *